United States Patent [19]

Vrzalik

[11] Patent Number: 5,003,654

[45] Date of Patent: Apr. 2, 1991

[54] METHOD AND APPARATUS FOR ALTERNATING PRESSURE OF A LOW AIR LOSS PATIENT SUPPORT SYSTEM

[75] Inventor: John H. Vrzalik, San Antonio, Tex.

[73] Assignee: Kinetic Concepts, Inc., San Antonio, Tex.

[21] Appl. No.: 251,949

[22] Filed: Sep. 28, 1988

Related U.S. Application Data

[63] Continuation of Ser. No. 57,965, Jun. 1, 1987, abandoned, which is a continuation-in-part of Ser. No. 905,553, Sep. 9, 1986, abandoned, which is a continuation-in-part of Ser. No. 784,875, Oct. 4, 1985, abandoned, which is a continuation-in-part of Ser. No. 683,153, Dec. 17, 1984, abandoned.

[51] Int. Cl.[5] ..... A61G 7/04

[52] U.S. Cl. ..... 5/453; 5/455

[58] Field of Search ..... 5/61, 449, 453–457, 5/468, 469

[56] References Cited

U.S. PATENT DOCUMENTS

| | | |
|---|---|---|
| 359,879 | 3/1887 | Miller . |
| 552,672 | 1/1897 | Souney et al. . |
| 587,014 | 7/1897 | Packard . |
| 728,865 | 5/1903 | Cheetham . |
| 1,021,335 | 3/1912 | Robinson . |
| 1,334,042 | 3/1920 | Lopatka . |

(List continued on next page.)

FOREIGN PATENT DOCUMENTS

| | | |
|---|---|---|
| 210469 | 4/1956 | Australia . |
| 592676 | 2/1960 | Canada . |
| 0122666 | 10/1984 | European Pat. Off. . |
| 0168213 | 1/1986 | European Pat. Off. . |
| 2816642 | 4/1978 | Fed. Rep. of Germany . |
| 3217981 | 5/1982 | Fed. Rep. of Germany . |
| 1462733 | 12/1966 | France . |
| 30112 | 5/1971 | Ireland . |
| 8606624 | 11/1986 | PCT Int'l Appl. ..... 5/453 |
| 946831 | 1/1964 | United Kingdom . |
| 1059100 | 2/1967 | United Kingdom . |
| 2026315A | 2/1980 | United Kingdom . |
| 2090734A | 7/1982 | United Kingdom . |

OTHER PUBLICATIONS

Brochure entitled, "The Egerton Turning and Tilting Bed Mark 2"; Egerton Hospital Equipment, Ltd. (England).

(List continued on next page.)

*Primary Examiner*—Michael F. Trettel

*Attorney, Agent, or Firm*—Cox & Smith Incorporated

[57] ABSTRACT

Method and apparatus for preventing bed sores in a bedridden patient. A low air loss bed is provided including a frame, a first set of substantially rectangular air bags for supporting a patient thereon mounted transversely on the frame, and a second set of substantially rectangular air bags for supporting a patient thereon mounted transversly on the frame, and all of the air bags are connected to a gas source. The configuration of the air bags is such that when the first set of air bags is inflated, the patient supported thereon is moved toward the first side of the frame of the low air loss bed and when the second set of air bags is inflated while the first set of air bags is deflated, the patient is moved toward the second side of the low air loss bed. The configuration of the air bags also retains the patient on the top surface of the air bags when the patient is rolled in one direction or the other.

The operator of the low air loss bed defines the pressures in individual air bags corresponding to each of three positions to which the patient is rotated. The pressures are maintained by a feedback control system which actuates valves connecting the gas source to separate sets of air bags. The three positions to be sequentially attained thereby causing controlled oscillation of the patient from one side of the bed frame to the other. Because each rotation position corresponds to operator defined pressures, the oscillation is customized for individuals of different body weights.

29 Claims, 17 Drawing Sheets

U.S. PATENT DOCUMENTS

| | | | |
|---|---|---|---|
| 1,644,043 | 10/1927 | Tiedemann . | |
| 1,676,420 | 7/1928 | Anderson . | |
| 1,740,906 | 12/1929 | Rothauszky et al. . | |
| 2,076,675 | 4/1937 | Sharp . | |
| 2,188,592 | 1/1940 | Cunningham . | |
| 2,522,018 | 9/1950 | Blackman . | |
| 2,534,471 | 12/1950 | Norheim . | |
| 2,667,169 | 1/1954 | Kambourakis . | |
| 2,690,177 | 9/1954 | Hogan . | |
| 2,841,802 | 7/1958 | Leverett . | |
| 3,238,539 | 3/1966 | Koch . | |
| 3,302,218 | 2/1967 | Stryker . | |
| 3,378,859 | 4/1968 | Parker . | |
| 3,434,165 | 3/1969 | Keane . | |
| 3,775,781 | 12/1973 | Bruno et al. . | |
| 4,451,944 | 6/1984 | James . | |
| 4,542,547 | 9/1985 | Sato | 5/456 X |
| 4,638,519 | 1/1987 | Hess | 5/455 |
| 4,686,722 | 8/1987 | Swart et al. | 5/455 X |
| 4,694,520 | 9/1987 | Paul et al. | 5/455 X |
| 4,745,647 | 5/1988 | Goodwin | 5/469 X |
| 4,797,962 | 1/1989 | Goode | 5/455 X |

OTHER PUBLICATIONS

Brochure entitled, "Egerton General Product Information"; Egerton Hospital Equipment, Ltd. (England).

Flyer or page from brochure showing Egerton Net Suspension Bed; Egerton Hospital Equipment, Ltd. (England).

Article entitled, "When You Can't Just Hop Into Bed!", Kentish Times, p. 15 (Oct. 25, 1973).

Brochure entitled, "How We Have Taken the Back Out of One of the Heaviest Jobs in Nursing"; LIC Care (Sweden).

Brochure entitled, "Mecabed—Pressure Sores Prevention and Treatment by Mecanaids"; Mecanaids Ltd. (U.K.).

Brochure entitled, "Immobility the Cause . . . ROTO REST the Cure".

Brochure entitled, "Dr. Volkner's Lamellar Turning Bed"; Jan Stahl GmbH (West Germany).

Brochure entitled, "Behind These Doors Lies the Solution to Managing Your Most Critical Patients"; Kinetic Concepts, Inc. (U.S.).

METHOD AND APPARATUS FOR ALTERNATING PRESSURE OF A LOW AIR LOSS PATIENT SUPPORT SYSTEM

BACKGROUND OF THE INVENTION

The present application is a continuation of co-pending application Ser. No. 057,965, filed on June 1, 1987, now abandoned, which is a continuation-in-part application of my co-pending application Ser. No. 905,553, filed on Sept. 9, 1986, now abandoned, which is a continuation-in-part application of my co-pending application Ser. No. 784,875, filed on Oct. 4, 1985, now abandoned, which is a continuation-in-part application of application Ser. No. 683,153, filed on Dec. 17, 1984 now abandoned.

The present invention relates to a method and apparatus for alternating the air pressure of a low air loss patient support system. More particularly, it relates to a bed having a frame with two sets of air bags mounted thereto, a gas source, means on each of the air bags for moving a patient supported thereon toward one side of the frame and then back toward the other side of the frame when gas is supplied to the first set of air bags and then to the second set of air bags, and means on the air bags for retaining the patient on the air bags when the patient is moved toward the respective sides of the frames.

Such a bed can be used to advantage for the prevention of bed sores and the collection of fluid in the lungs of bedridden patients. Other devices are known which are directed to the same object, but these devices suffer from several problems. In particular, U.S. Pat. No. 3,822,425 discloses an air mattress consisting of a number of cells or bags, each having a surface which supports the patient formed from a material which is gas permeable but is non-permeable to liquids and solids. It also discloses an air supply for inflating the cells to the required pressure and outlets or exhaust ports to allow the escape of air. The stated purpose of the outlets is to remove condensed vapor for the cells or bags. The outlets on that mattress may be fitted with valves to regulate the air pressure in the cells as opposed to regulating the air pressure in the cells by controlling the amount of air flowing into the cells. However, the air bed which is described in that patent and which is currently being marketed under that patent is believed to have certain disadvantages and limitations.

For example, that bed has a single air intake coupler, located directly and centrally underneath the air mattress, for connection of the source of air. Access to this connection is difficult since one must be on their back to reach it. The location of the connection underneath the mattress creates a limitation in the frame construction because the air hose must pass between the bed frame members. The source of air to which the air hose is connected is a blower or air pump mounted in a remote cabinet which, because it must be portable, is mounted on casters. There are many times in actual use when the cabinet must be moved in order to wheel other equipment, such as I.V. stands, around it or for access to the patient. However, relocation of this blower unit by any significant distance requires disconnection of the air hose from the frame (inconvenient because of the location up underneath the frame) or the pendant control in order to avoid wrapping the air hose around the bed frame members. Of course, disconnection of the air hose results in the loss of air pressure in the air mattress, which is even less desirable.

Further, the bed disclosed by that patent is limited in that only a finite amount of air can be forced or pumped into the air mattress. By eliminating the outlets described in that patent entirely, the air pressure in the bags can at least be maintained at that point which represents the maximum output of the source of gas. In the case of the bed described in that patent, if it is necessary to further increase the pressure in the air bags while the outlets are being used for their stated purpose, the only way to do so is to install a larger capacity blower in the cabinet. High air pressures may be necessary, for instance, to support obese patients. A larger capacity blower generally requires more power consumption and a higher capacity circuit which may not be readily available. Also, the larger the blower, the more noise it creates which is not desirable.

Another limitation of that bed is the necessity for constant adjustment of the air pressure in the air bags on which the patient is supported. Although low air loss beds in general are used for bedridden patients, not all bedridden patients are incapable of movement. Each movement of those patients, even such movements as moving only one arm, or each time a patient incapable of movement is re-positioned by attending health-care personnel, causes changes in the portion of the patient's weight supported by the sets of air bags mounted on the respective head, back, seat and leg sections of the frame of the bed. To avoid the localized increases in the pressure exerted against the skin of the patient as a result of such movements, the air pressure in that section must be re-adjusted. Adjustment of the air supply to one set of air bags almost invariably has an effect on the pressure in one or more adjacent sets of air bags such that it is often necessary to change the air supply to every set of air bags on the bed.

Further, low air loss beds of the type disclosed in the '425 patent are provided with means for adjusting the patient's attitude on the bed. For instance, the head of the bed can be raised to sit the patient up or the angle of the entire frame of the bed can be changed with respect to the horizontal when, for therapeutic reasons, the patient is placed in the Trendelenburg or reverse Trendelenburg positions. Those changes require re-adjustment of the air supply in each set of air bags, usually of a greater magnitude than those required as a result of the movement of the patient.

The limitations and disadvantages which characterize other previous attempts to solve the problem of preventing bed sores in bedridden patients are well characterized in G. B. Patent No. 1,474,018 and U.S. Pat. No. 4,425,676.

The prior art also discloses a number of devices which function to rock a patient back and forth by the use of air pressure. For instance, U.S. Pat. Nos. 3,477,071, 3,485,240, and 3,775,781 disclose hospital beds with an inflatable device for shifting or turning a patient lying on the bed by alternately inflating and deflating one or more inflatable cushions. U.K. Patent Application No. 2,026,315 discloses a pad, cushion, or mattress of similar construction. German Patent DE 28 16 642 discloses an air mattress for a bedridden person or hospital patient consisting of three longitudinal inflatable cells attached to a base sheet, the amount of air forced into each cell being varied so as to alternately rock the patient from one side of the mattress to the other. However, none of those mattresses or devices are designed for use in a low air loss patient support system. Further, the U.K. and German patents, and U.S. Pat. Nos. 3,477,071 and 3,775,781, disclose devices consisting of parallel air compartments which extend longitudinally along the bed and which are alternately inflated and deflated. Such a construction does not allow the use of the device on a bed having hinged sections corresponding to the parts of the patient's body lying on the bed so that the inclination and angle of the various portions of the bed can be adjusted for the patient's comfort.

U.S. Pat. No. 3,678,520 discloses an air cell for use in a pressure pad which is provided within a plurality of tubes which project from a header pipe such that the air cell assumes a comb-like conformation when inflated and viewed from above. Two such air cells are enclosed within the pressure pad with the projecting tubes interdigitating, and air is alternately provided and exhausted from one cell and then the other. That device is not suitable for use on a bed having hinged sections corresponding to the parts of the patient's body lying on the bed so that the angle of inclination of the various portions of the bed can be adjusted for the patient's comfort, nor is it capable of functioning in the manner described if constructed in the low air loss conformation.

A number of patents, both U.S. and foreign, disclose air mattresses or cushions comprised of sets of cells which are alternately inflated and deflated to support a patient first on one group of air cells and then the other group. Those patents include the following U.S. patents: 1,772,310, 2,245,909, 2,998,817, 3,390,674, 3,467,081, 3,587,568, 3,653,083, 4,068,334, 4,175,297, 4,193,149, 4,197,837, 4,225,989, 4,347,633, 4,391,009, and 4,472,847, and the following foreign patents: G.B. 959,103, Australia 401,767, and German 24 46 935, 29 19 438 and 28 07 038. None of the devices disclosed in those patents rocks or alternately moves the patient supported thereon to further distribute the patient's body weight over additional air cushions or cells or to alternately relieve the pressure under portions of the patient's body.

There are also a number of patents which disclose an inflatable device other than an air mattress or cushion but which also involves alternately supplying air to a set of cells and then to another set of cells. Those patents include U.S. Pat. Nos. 1,147,560, 3,595,223, and 3,867,732, and G.B. Patent No. 1,405,333. Of those patents, only the British patent discloses the movement of the body with changes in air pressure in the cells of the device. None of those references disclose an apparatus which is adaptable for use in a low air loss patient support system.

British Patent No. 946,831 discloses an air mattress having inflatable elongated bags which are placed side-by-side and which are in fluid communication with each other. A valve is provided in the conduit connecting the insides of the two bags. Air is supplied to both bags in an amount sufficient to support the patient, thereby raising the patient off the bed or other surface on which the air mattress rests. Any imbalance of the weight distribution of the patient causes the air to be driven from one bag to the other, allowing the patient to turn toward the direction of the now deflated bag. An automatic changeover valve, the details of which are not shown, is said to then inflate the deflated bag while deflating the bag which was originally inflated, thereby rocking the patient in the other direction. That device is limited in its ability to prevent bed sores because when the patient rocks onto the deflated bag, there is insufficient air to support the patient up off the bed or other surface on which the air mattress rests, resulting in pressure being exerted against the patient's skin which is essentially the same as the pressure that would have been exerted by the board or other surface without the air mattress. Even if there were enough air left in the deflated bag to support the patient, if the air mattress were constructed in a low air loss configuration, the air remaining in the bag would be slowly lost from the bag until the patient rested directly on the bed or other surface with the same result. Finally, that device is not adaptable for use on a bed having hinged sections corresponding to the parts of the patient's body lying on the bed so that the angle of inclination of the various portions of the bed can be adjusted for the patient's comfort.

The present invention represents an improved apparatus over the prior art. It is characterized by a number of advantages which increase its utility over the prior art devices, including its flexibility of use, its ability to maintain relatively constant air pressure in the air bags in spite of patient movement or changes in the attitude of the bed frame, the ability to quickly and easily replace one or more of the air bags while the apparatus is in operation, and the ease of adjustment of the air pressure in the air bags.

It is, therefore, an object of the present invention to provide a low air loss bed comprising a frame, a first set of substantially rectangular gas permeable air bags for supporting a patient thereon mounted transversely on the frame, a second set of substantially rectangular gas permeable air bags for supporting a patient thereon mounted transversely on the frame, means for connecting each of the air bags to a gas source, means integral with each of the air bags of the first set of air bags for moving the patient supported thereon toward a first side of the frame when each of the air bags in the first portion is inflated, means integral with each of the air bags of the second set of air bags for moving the patient supported thereon toward a second side of the frame when the air bags in the first set of air bags are deflated and the air bags of the second set of air bags are inflated, integral means on each of the air bags for retaining the patient alternately supported on the first or second set of air bags when the patient is moved toward the first or second sides of the frame, and means for selecting the pressure in the air bags at any given time.

It is a further object of the present invention to provide an air bed, the air pressure of which can be quickly and conveniently set to support a patient of known body weight by simply selecting a target pressure to be maintained in the air bags which results in the adjustment of the valves regulating the amount of air flowing from the air source accordingly.

Another object of the present invention is to provide a low air loss bed having an integral gas source which can be raised, lowered or tipped, and which allows the raising or lowering of a portion of the bed while maintaining a selected pressure or range of pressures in the air bags at any given time.

Another object of the present invention is to provide a low air loss bed capable of rolling a patient back and forth on the bed while safely retaining the patient thereon.

Another object of the present invention is to provide a low air loss bed capable of alternately moving a patient in one direction and then in a second direction which is divided into at least three sections approximately corresponding to the portions of the body of the patient lying thereon which are hinged to each other and provided with means for raising and lowering the sections corresponding to the body of the patient to provide increased comfort and therapeutic value to the patient while the patient is being alternately moved in the first and second directions on the bed.

Another object of the present invention is to provide a low air loss bed capable of alternately rolling a portion of a patient in one direction and then in a second direction while retaining another portion of the patient in a relatively fixed position.

Other objects and advantages will be apparent to those of skill in the art from the following disclosure.

SUMMARY OF THE INVENTION

These objects and advantages are accomplished in the present invention by providing a frame with a source of gas mounted thereon. A plurality of sets of gas permeable air bags are mounted on the frame, each set of air bags corresponding to a portion of a patient to be supported in prone position on the bed. Each of a plurality of separate gas manifolds communicates with the gas source and one set of the sets of air bags. Also provided is a means for separately changing the amount of gas delivered by the gas source to each of the gas manifolds, thereby varying the amount of support provided for each portion of the patient.

Also provided is a low air loss bed comprising a bed frame having a source of gas and a plurality of sets of water vapor permeable air bags mounted thereto. Separate gas manifolds communicate with the interior of the air bags on one set of the sets of air bags and the gas source. An air control box is mounted to the bed frame and interposed in the flow of air from the gas source to the gas manifolds, and is provided with individually adjustable valves for changing the amount of gas delivered to each of the gas manifolds. The air control box is also provided with means operable to selectively open all of the valves to the atmosphere, allowing the gas to escape from each of the sets of air bags, to collapse the air bags with the result that the patient is supported by the frame of the air bed rather than the air bags.

Also provided with a low air loss bed having a bed frame and a plurality of sets of air bags mounted thereto with a plurality of gas manifolds communicating separately with the gas source and the interior of the air bags. An air control box is mounted to the bed frame in fluid connection with the gas source and the gas manifolds, and is provided with valves which are individually adjustable to change the amount of the flow from the gas source through the air control box to each of the gas manifolds. The air control box is also provided with means operable to simultaneously fully open the valves to cause the air bags to fully inflate.

Also provided is a low air loss bed having a frame and a plurality of sets of air bags mounted thereto with a plurality of gas manifolds communicating separately with the gas source and the interior of the air bags. An air control box is also mounted on the frame, the interior of the air control box communicating with the gas manifolds and the gas source and having means therein for separately changing the amount of gas delivered by the gas source to each of the gas manifolds. The air control box is also provided with means operable to heat the gas flowing through the air control box and with means operable to switch the heating means on and off in response to the temperature in the air control box. Also provided is means having a sensor in one of the gas manifolds which is operable to selectively control the heating means, the means operable to switch the heating means on and off in response to the temperature in the air control box being operable at a predetermined temperature.

Also provided is a low air loss bed comprising a frame, a first set of air bags for supporting a patient thereon mounted transversely on the frame, a second set of air bags for supporting a patient thereon mounted transversely on the frame, means for connecting each of the air bags to a gas source, each of the air bags of said first set of air bags having means integral therewith for moving the patient supported thereon toward a first side of the frame when the air bags in the first set of air bags is inflated, each of the second set of air bags having means integral therewith for moving the patient supported thereon toward the second side of the frame when the air bags in the second set of air bags is inflated and the air bags in the first set of air bags is deflated, and means on the air bags for retaining the patient supported thereon when the patient is moved toward the respective first and second sides of the frame.

Also provided is a means for controlling the pressures in the air bags corresponding to three different rotation positions. These pressures are adjustable by the operator and serve to define each rotation position according to the size and weight of a particular patient. Means are provided which cause each rotation position to be sequentially reached and maintained at a rate defined by the operator.

Figure 1:
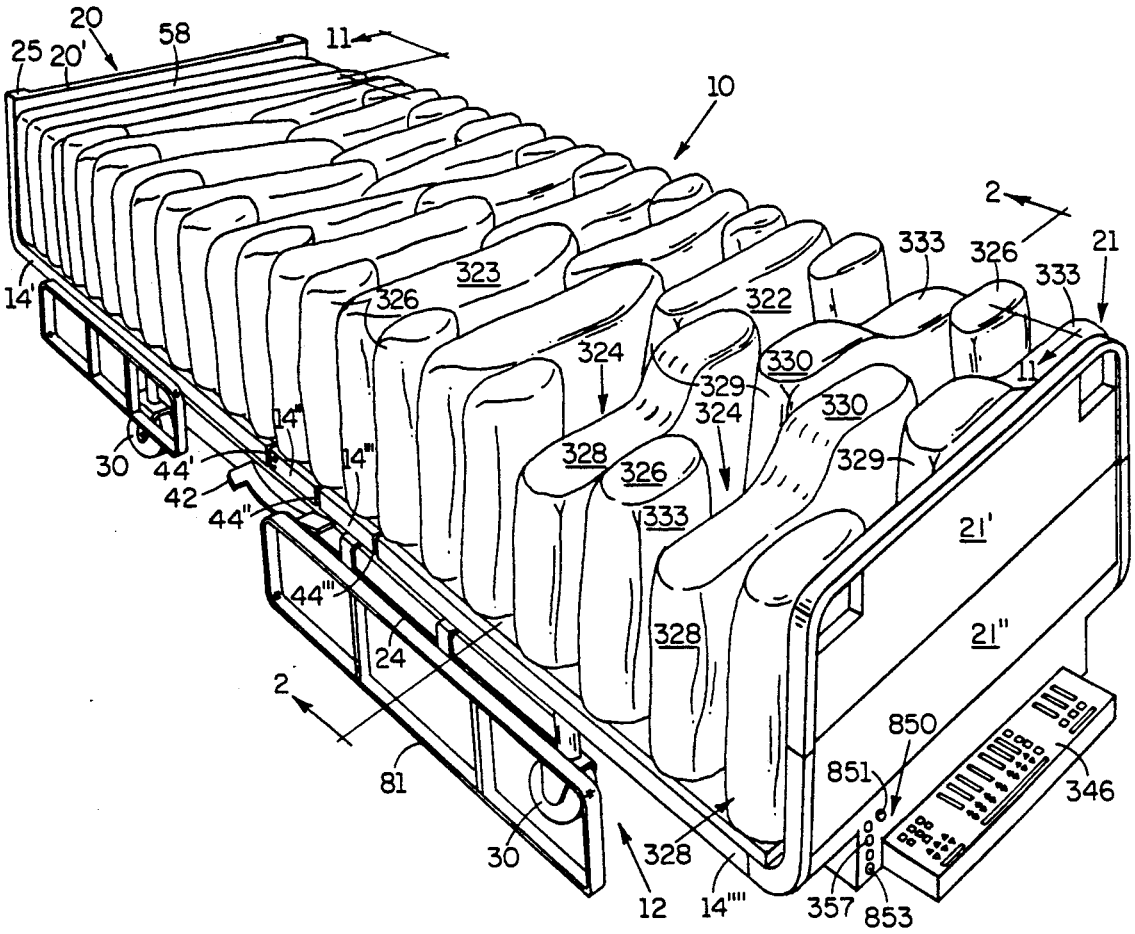
FIG. 1 is a perspective view of a presently preferred embodiment of the low air loss bed of the present invention.

FIG. is a cross-sectional view of the bed of FIG. 1, showing an air bag with a second air bag therebehind taken along the lines 2—2 in FIG. 1, the second air bag being shown in shadow lines for purposes of clarity.

Figure 3:
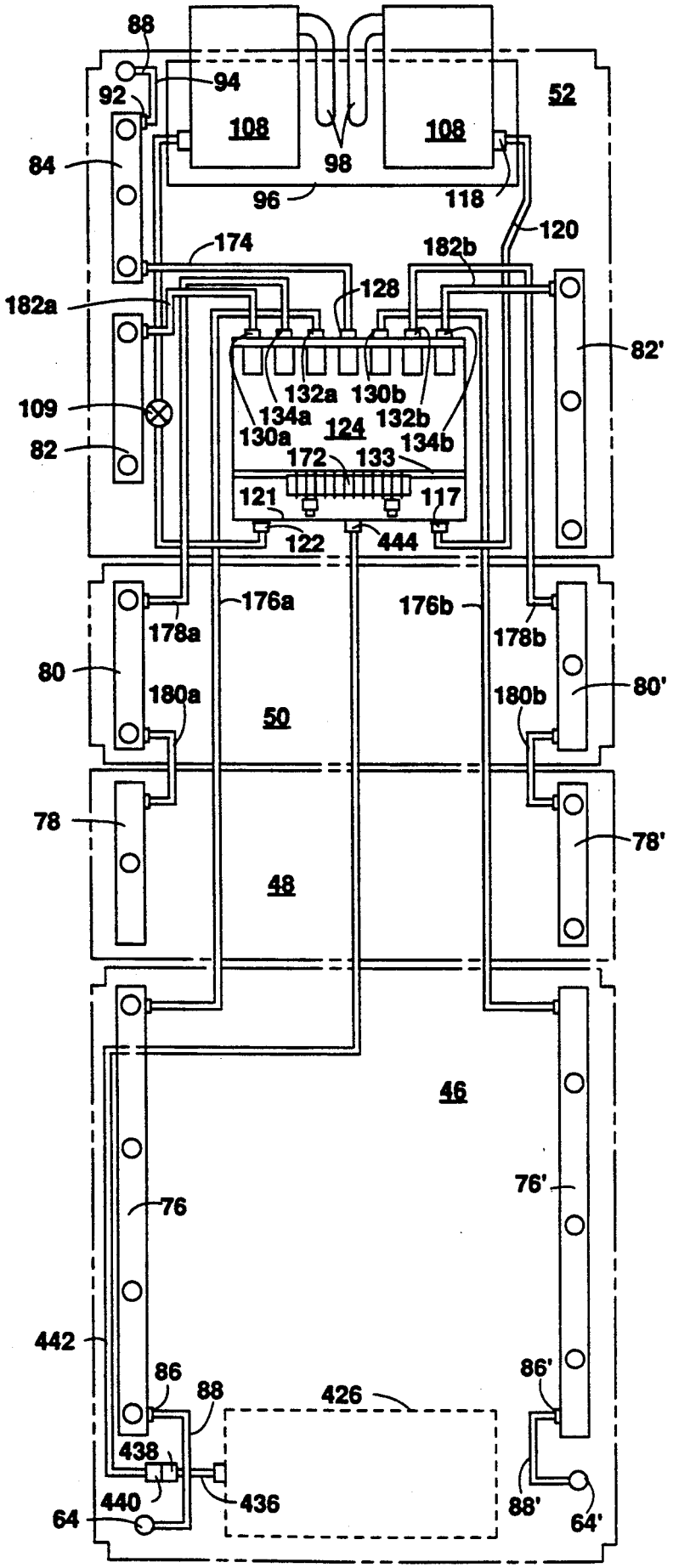

FIG. 3 is a schematic diagram of the air plumbing of the low air loss bed of FIG. 1.

Figure 4:
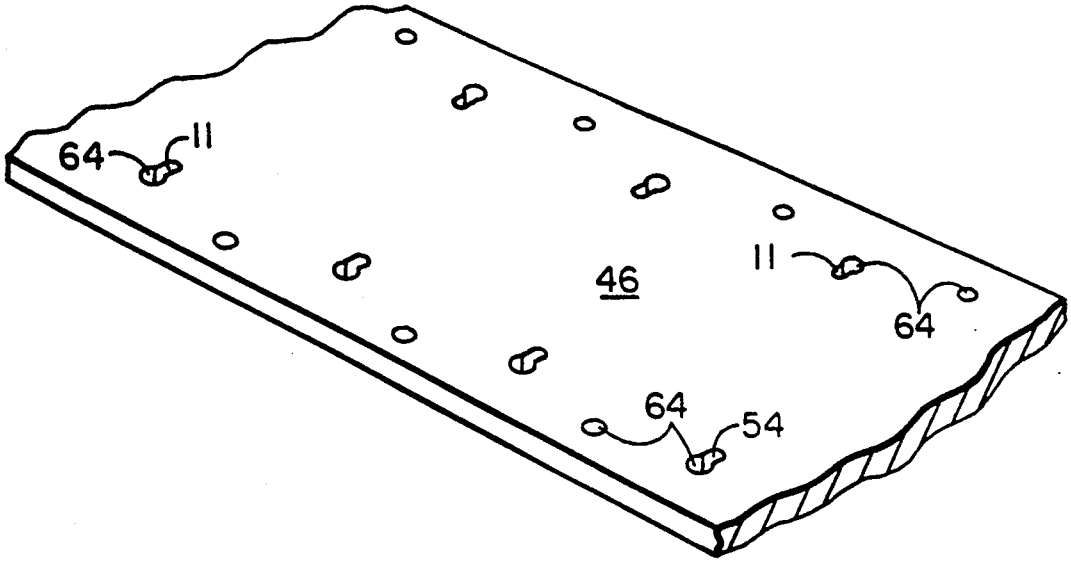

FIG. 4 is a perspective view of one of the baseboards of the low air loss bed of FIG. 1.

Figure 5:
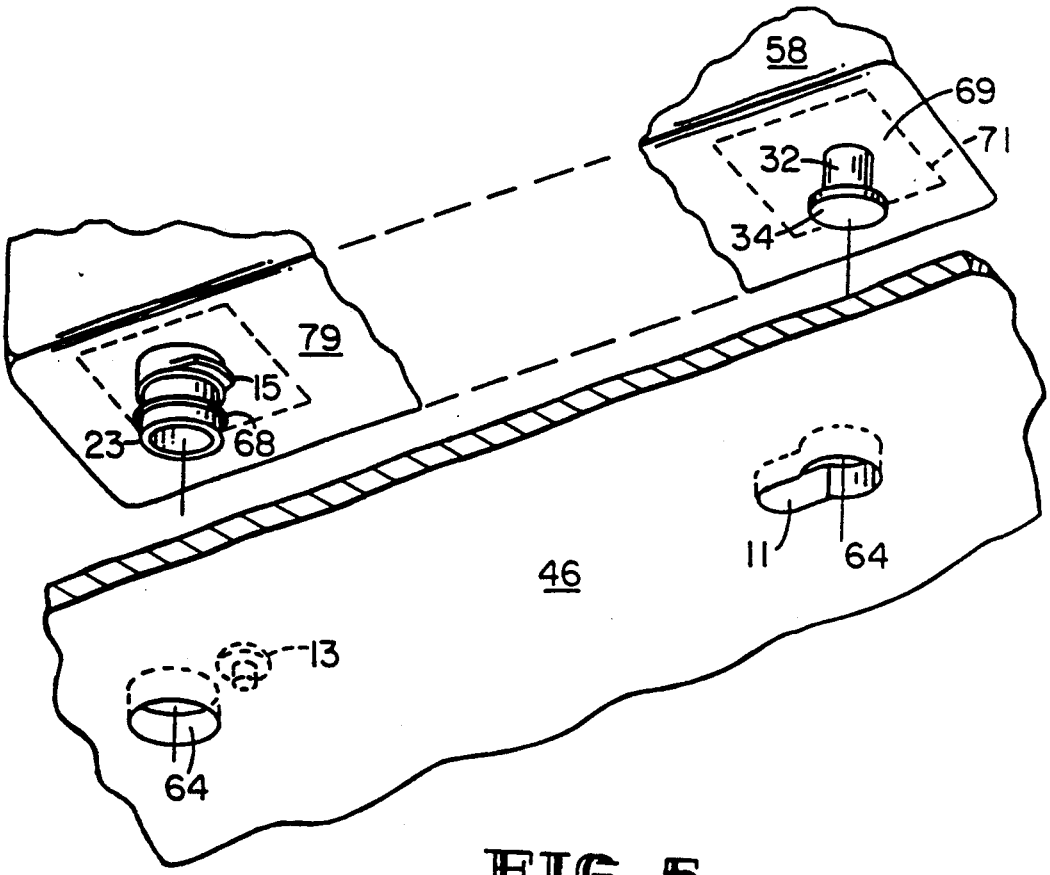

FIG. 5 is an enlarged, exploded perspective view of the underside of the baseboard of FIG. 4, showing the baseboard partially cut away to show the details of attachment of a low air loss air bag thereto.

Figure 6:
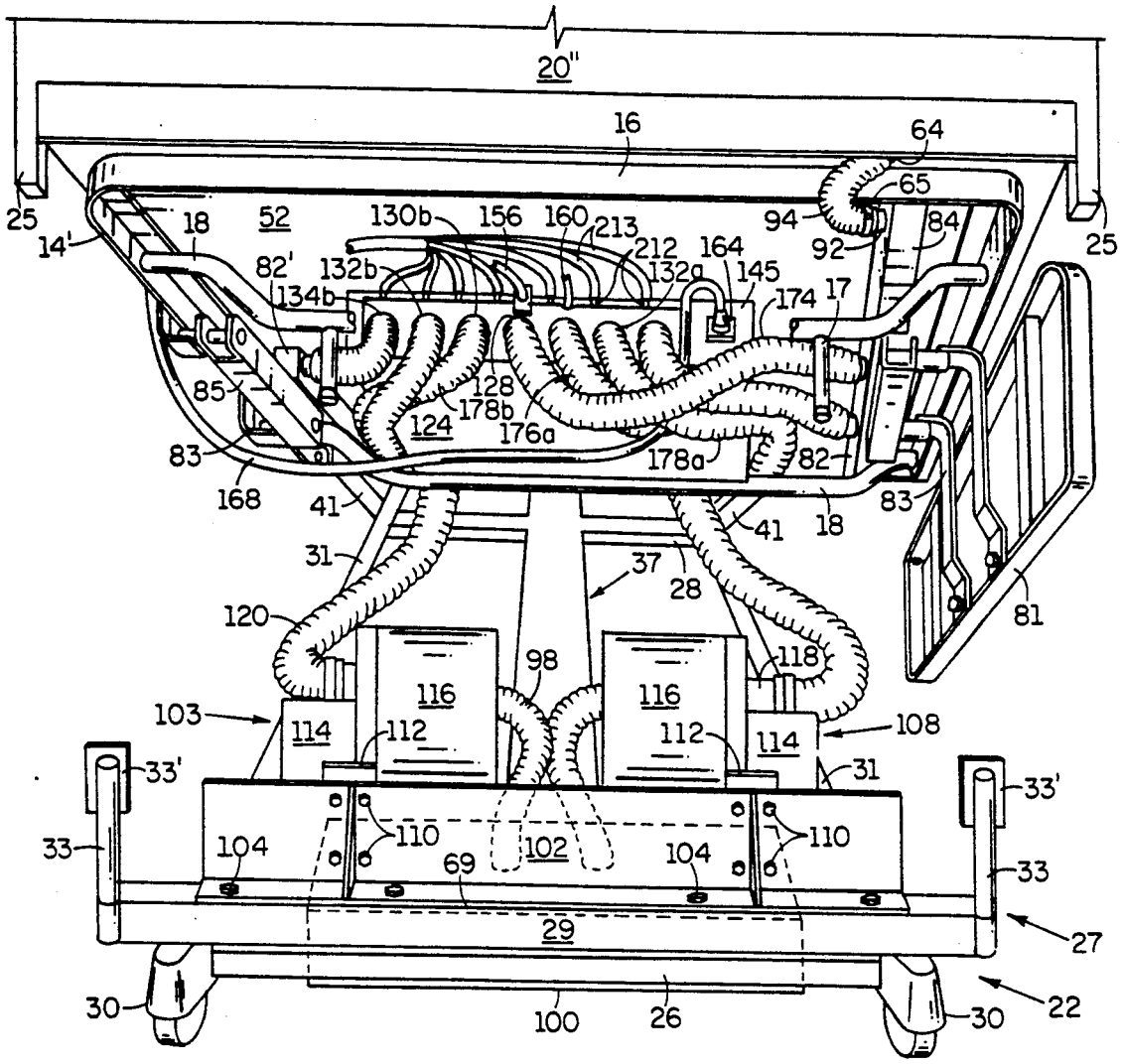

FIG. 6 is an end view of the low air loss bed of FIG. 1 with the head portion raised to show the construction of the frame and the components mounted thereto.

Figure 7:
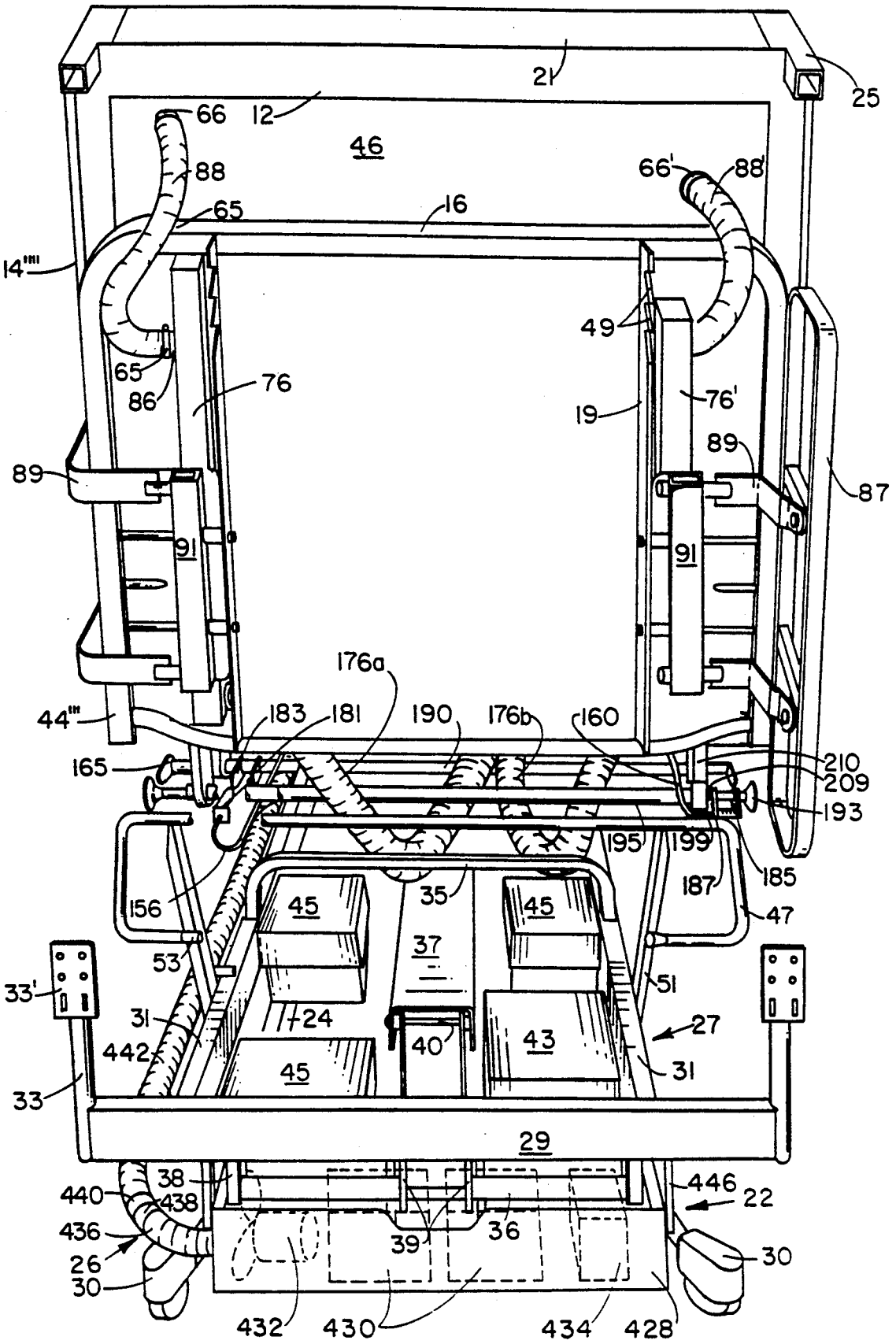

FIG. 7 is an end view of the low air loss bed of FIG. 1 with the foot portion raised to show the construction of the frame and the components mounted thereto.

Figure 8:
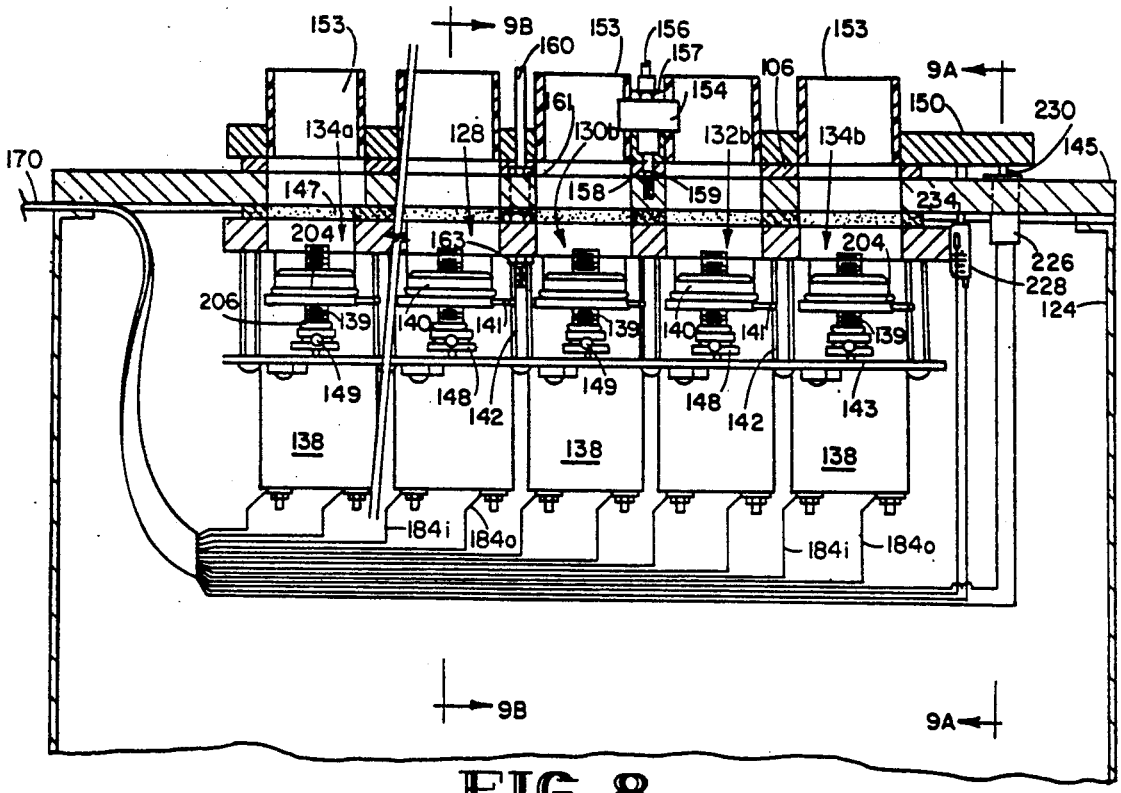
Figure 9A:
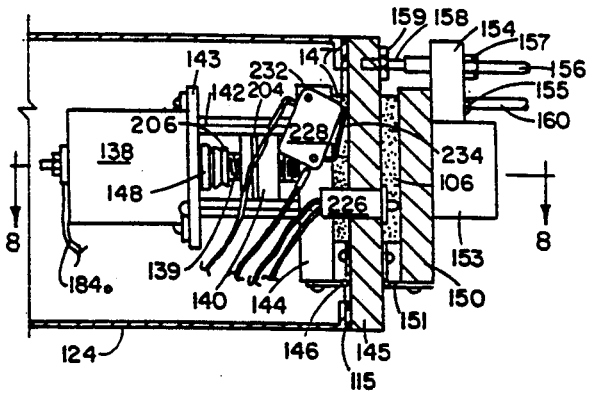

FIG. 8 is a sectional view of the air box of the low air loss bed of FIG. 1 taken along the lines 8—8 in FIG. 9A.

Figure 9B:
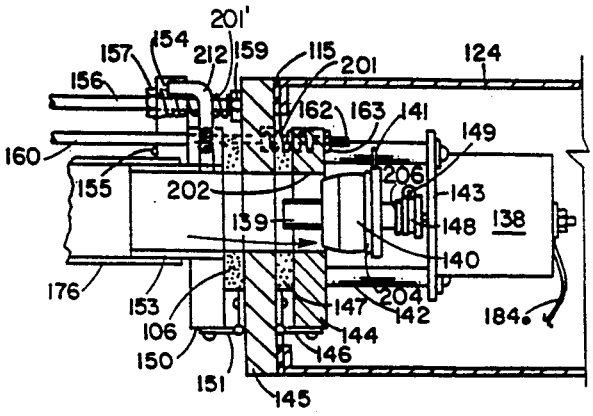

FIGS. 9A and 9B are cross-sectional views taken along the lines 9A—9A and 9B—9B, respectively, through the manifold assembly of the air box as shown in FIG. 8.

Figure 10A:
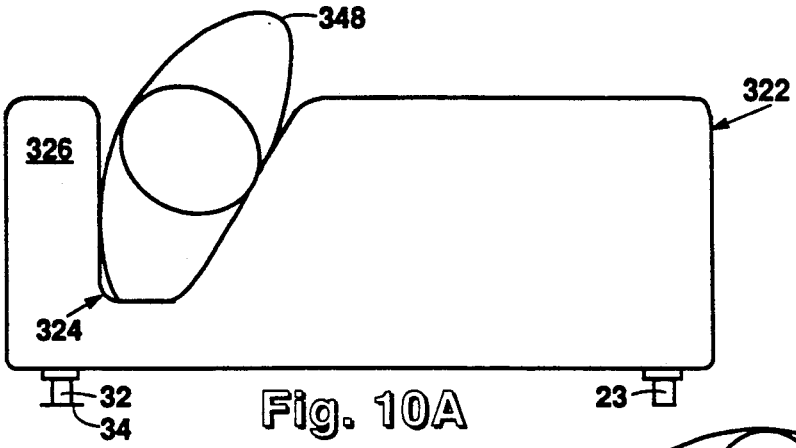
Figure 10B:
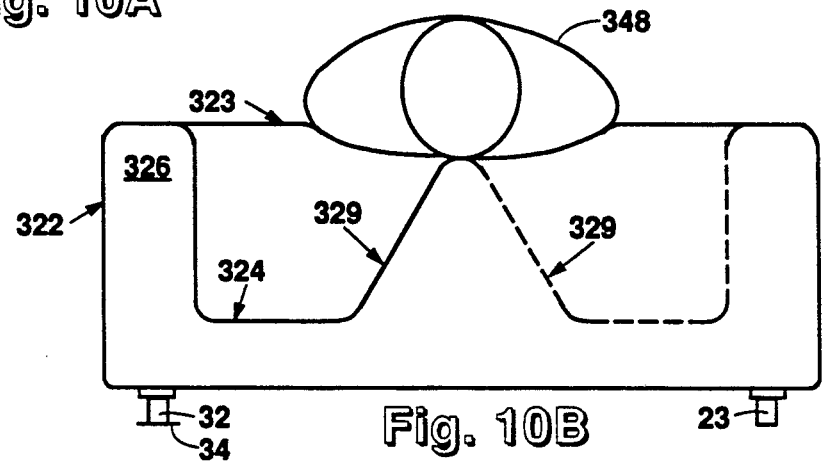

FIGS. 10A–10D are an end view of a patient supported upon the top surface of the air bags of the low air loss bed of the present invention as that patient (10D), is rocked toward one side of the frame of the low air loss bed (10A), then toward the other side (10C) or supported on the air bags when all air bags are fully inflated (FIG. 10B).

Figure 11:
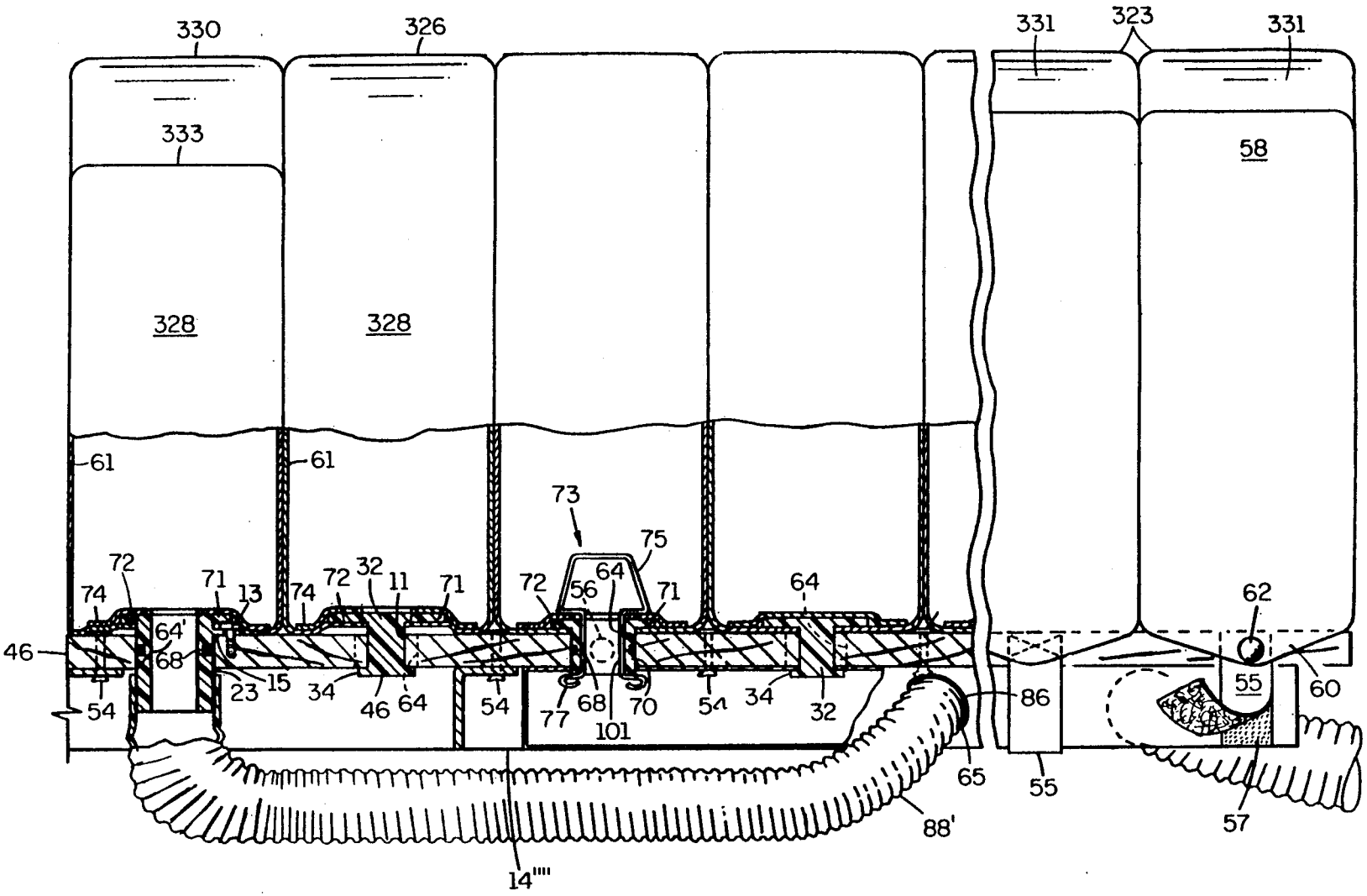

FIG. 11 is a composite, longitudinal sectional view of a portion of the foot baseboard of a low air loss bed constructed according to the teachings of the present invention taken along the lines 11—11 in FIG. 1 showing several alternate methods of attaching the air bags to the bed frame.

Figure 12:
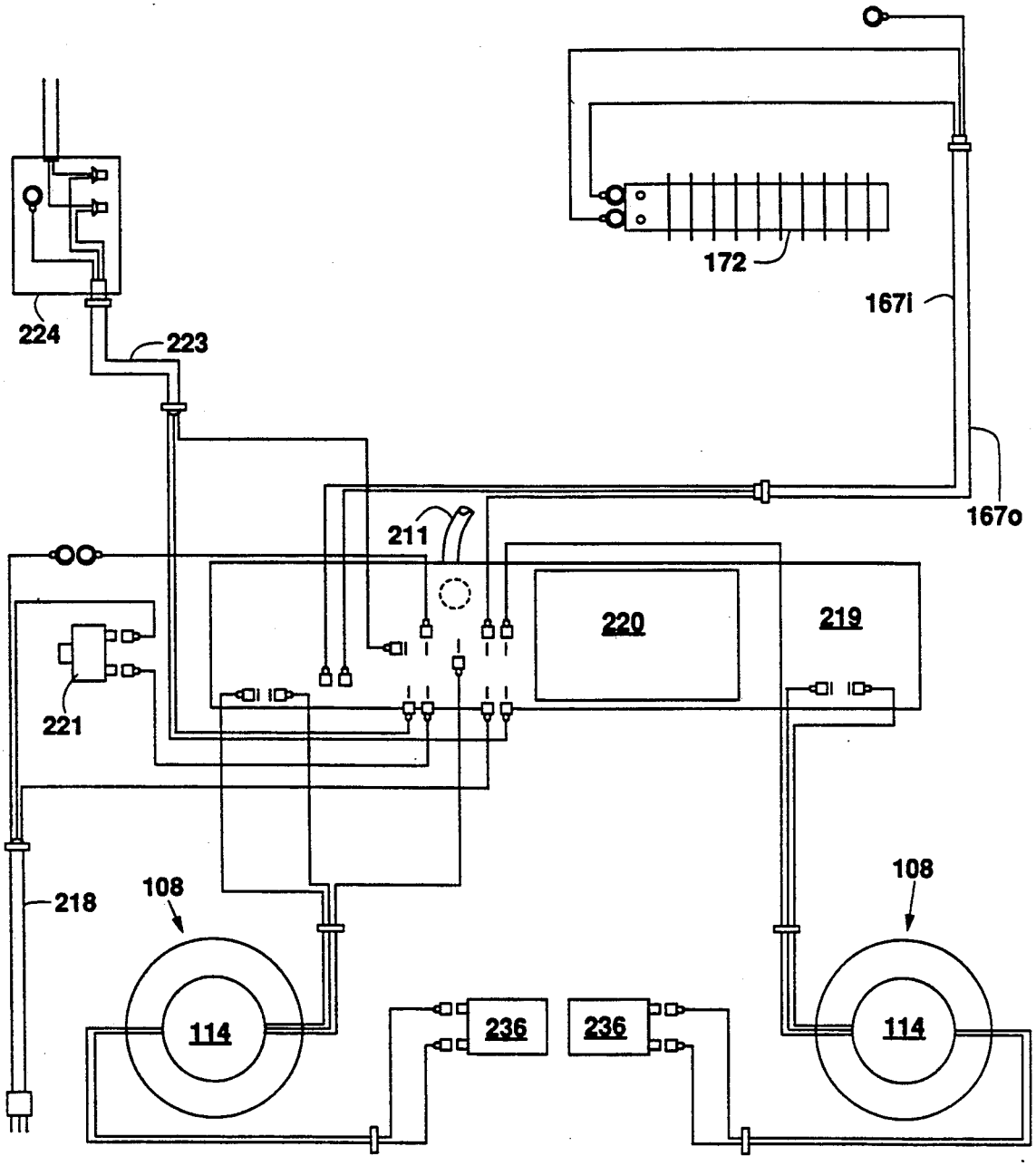

FIG. 12 is a schematic electrical diagram of the low air loss bed of FIG. 1.

Figure 13:
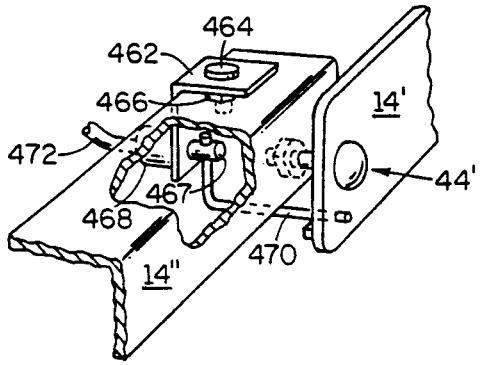

FIG. 13 is a perspective view of a portion of the bed frame of the bed of FIG. 1 showing a potentiometer mounted to one frame section which is pivotally connected to an adjacent frame section.

Figure 14:
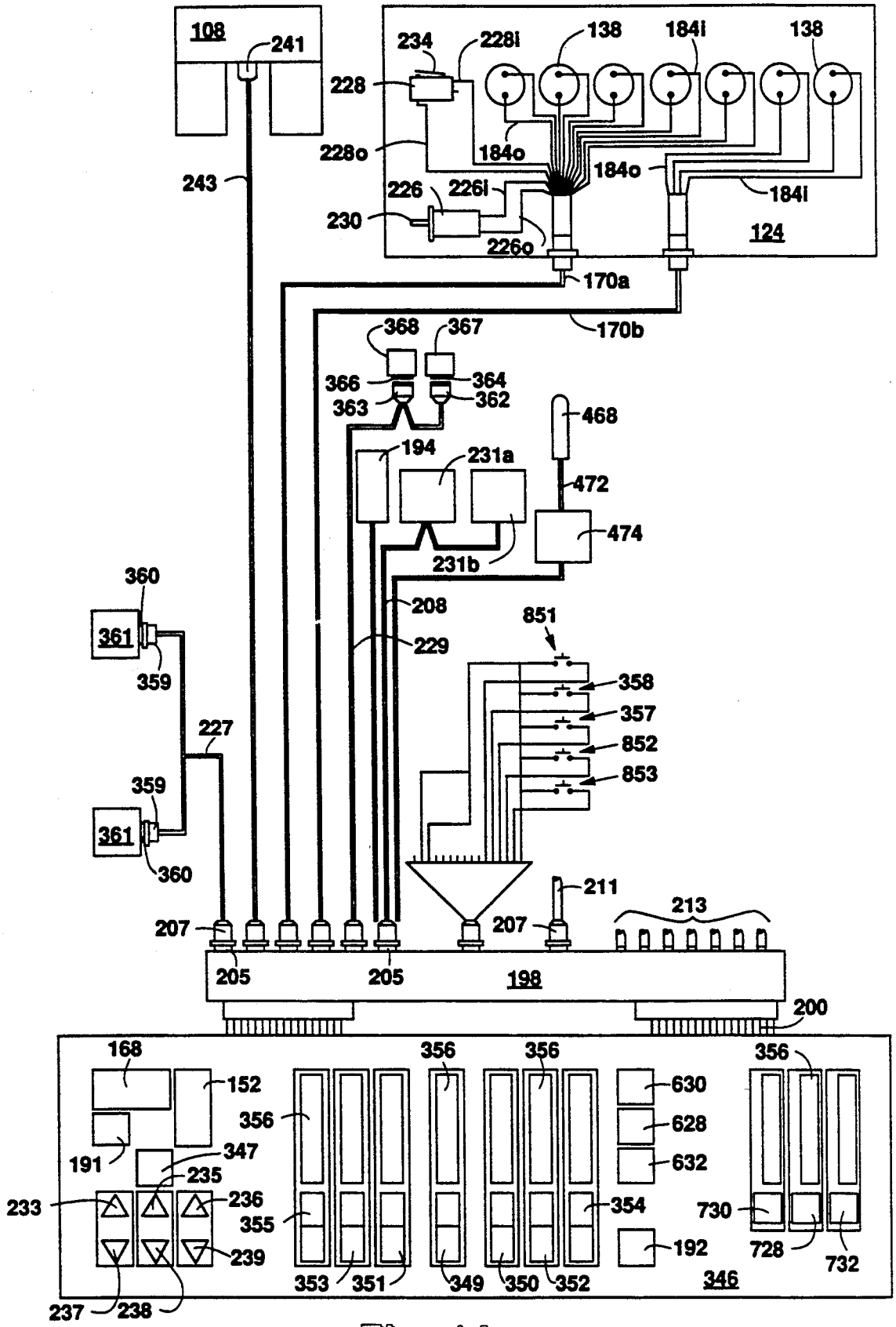

FIG. 14 is schematic diagram of the electrical cables and controls which open and close the valves toroute air to the air bags of the low air loss bed of FIG. 1.

Figure 15:
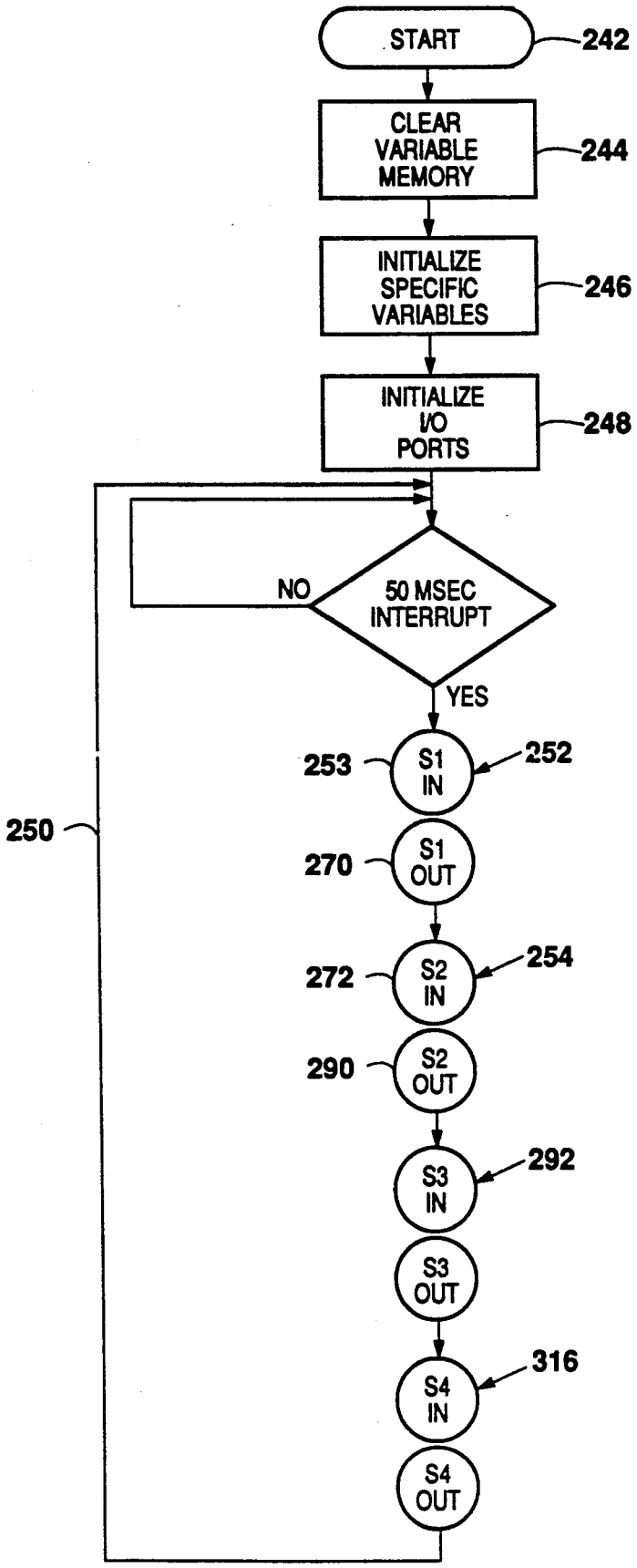

FIG. 15 is a flow chart of a presently preferred embodiment of the program for controlling the operations of the low air loss bed in FIG. 1 from the control panel shown in FIG. 12.

Figure 16:
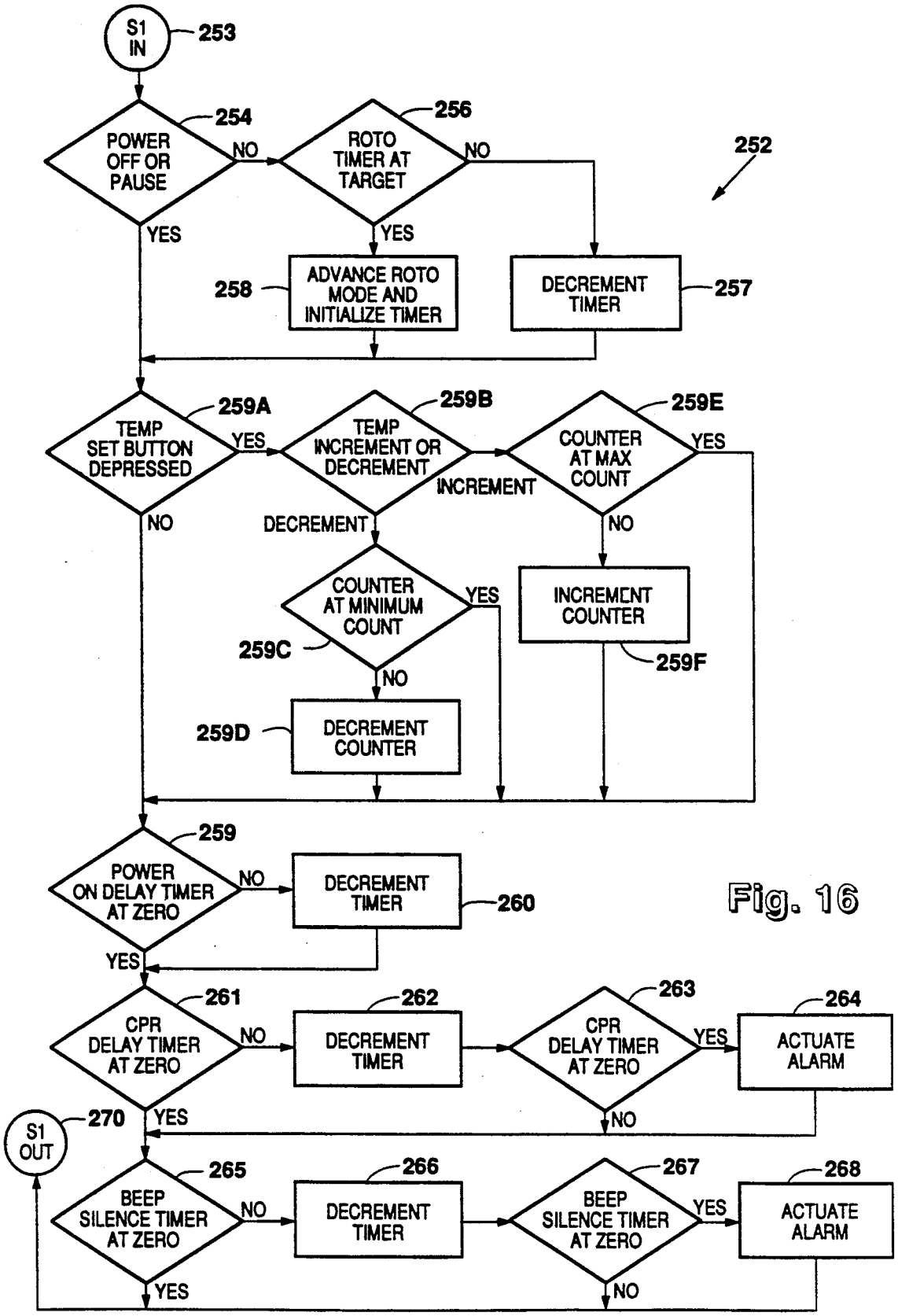

FIG. 16 is a flow chart of the general timer subroutine for controlling the operation of the low air loss bed of FIG. 1.

Figure 17:
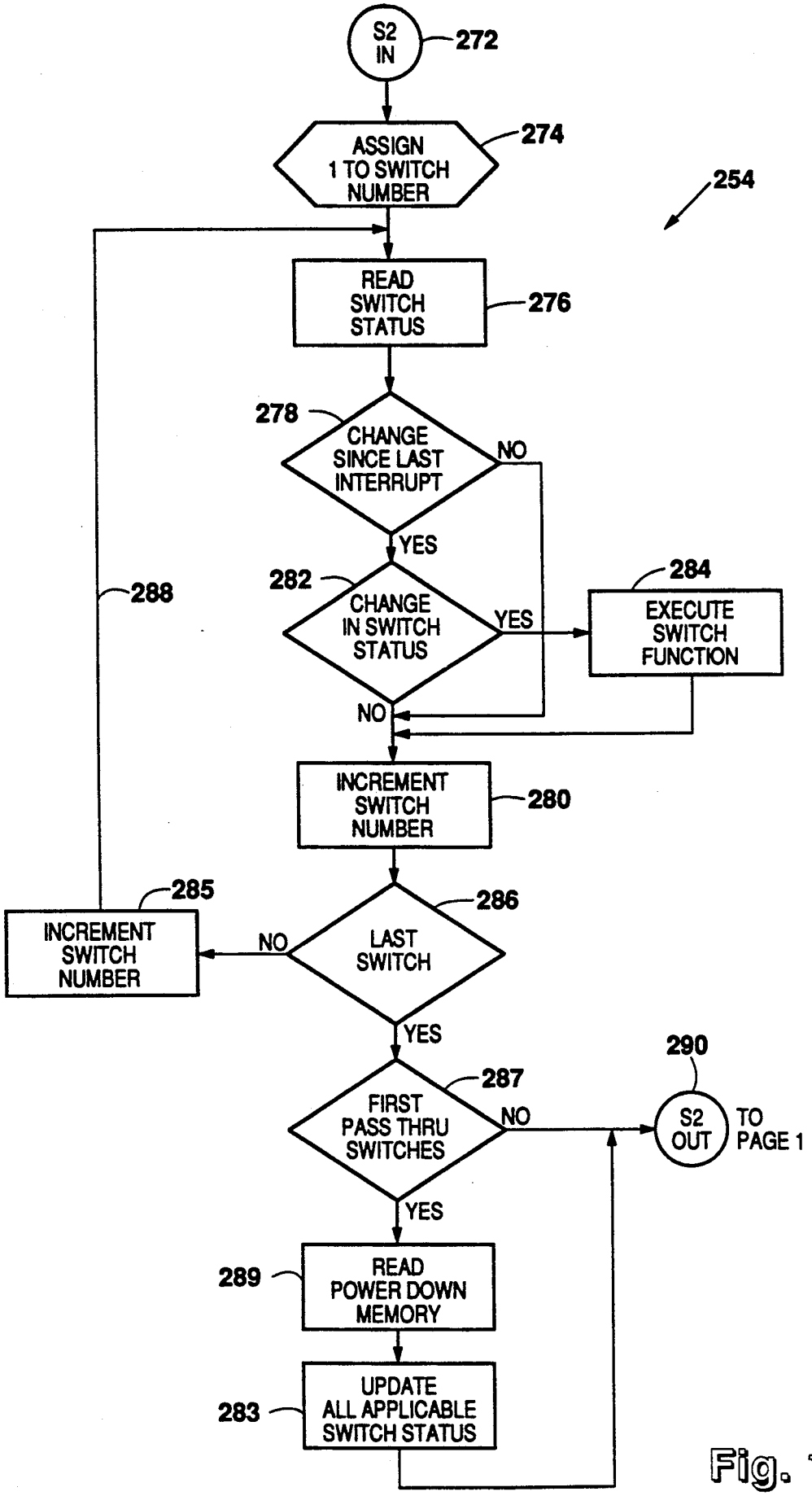

FIG. 17 is a flow chart of the switch processing subroutine for controlling the operation of the low air loss bed of FIG. 1.

Figure 18:
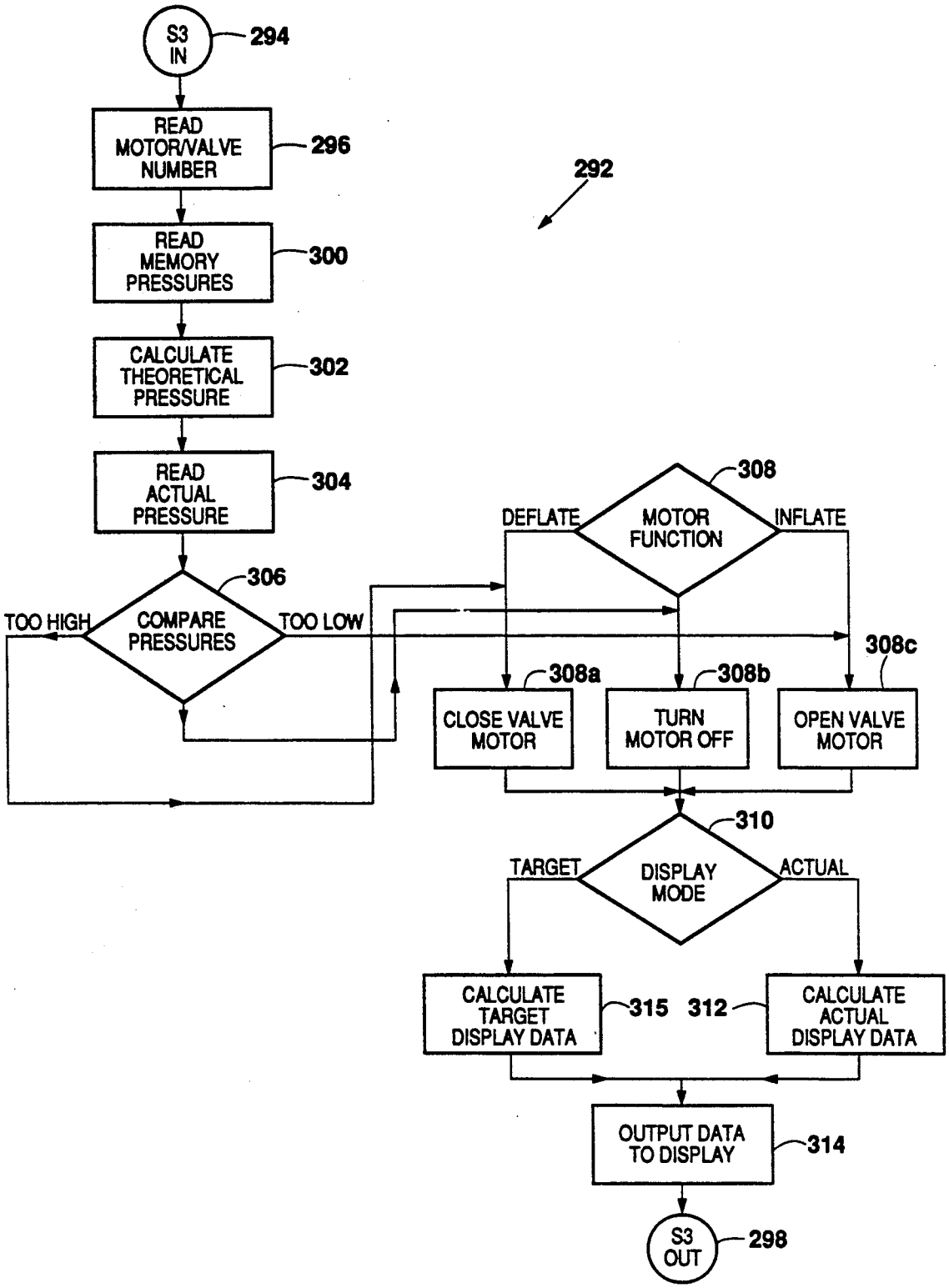

FIG. 18 is a flow chart of the rotation subroutine for controlling the operation of the low air loss bed of FIG. 1.

Figure 19:
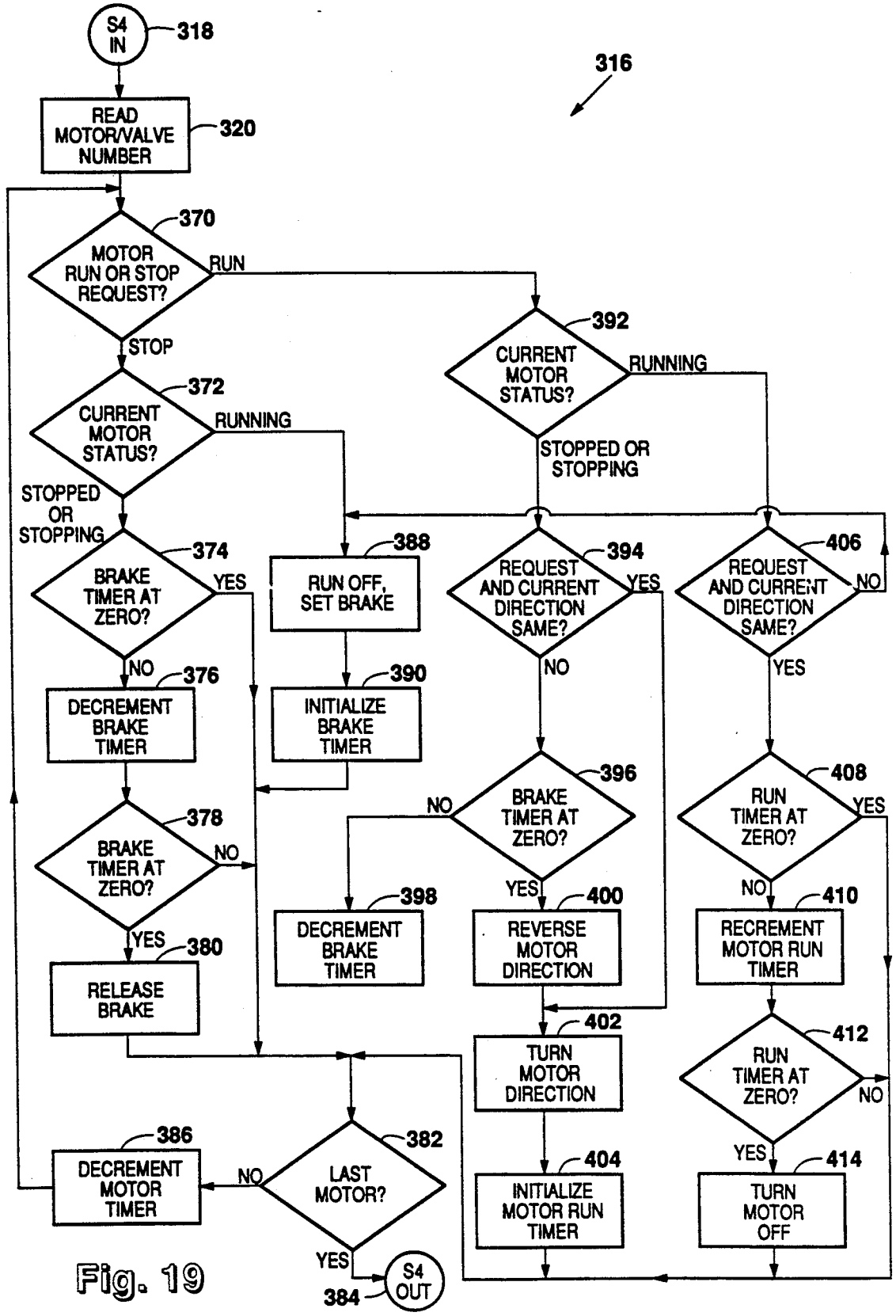

FIG. 19 is a flow chart of the valve motor subroutine for controlling the operation of the low air loss bed of FIG. 1.

Figure 20:
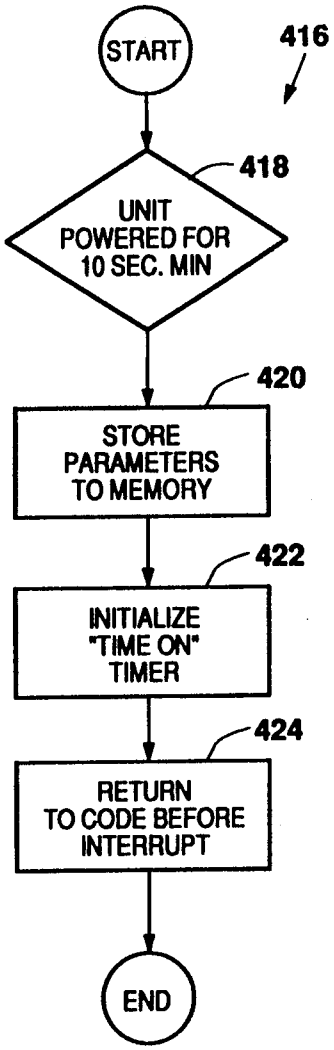

FIG. 20 is a flow chart of the power fail interrupt subroutine for controlling the operation of the low air loss bed of FIG. 1.

Figure 21:
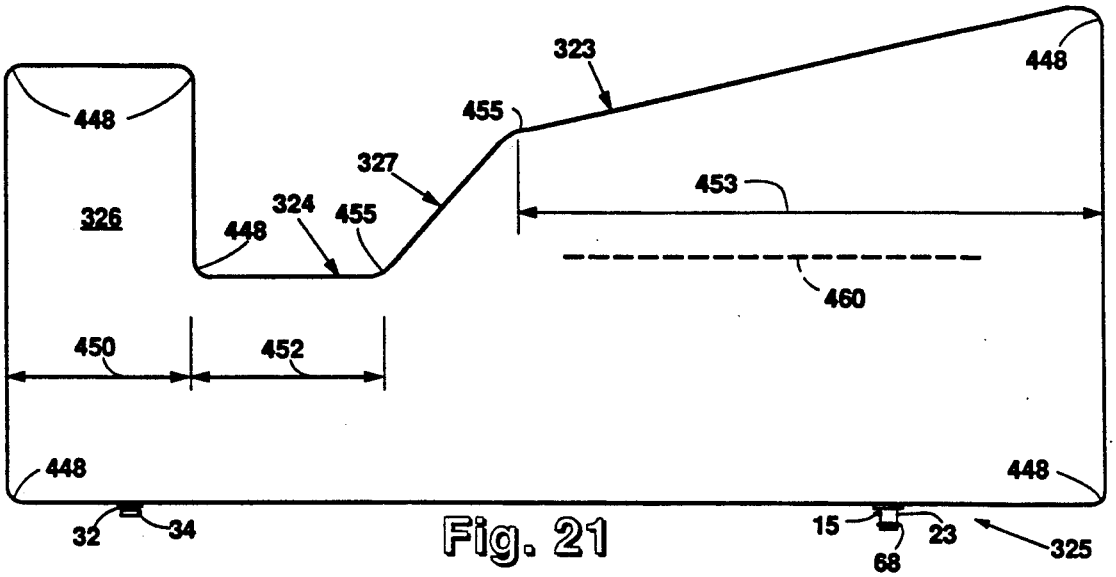

FIG. 21 is an end view of an alternative embodiment of an air bag for use on the low air loss bed of FIG. 1.

Figure 22:
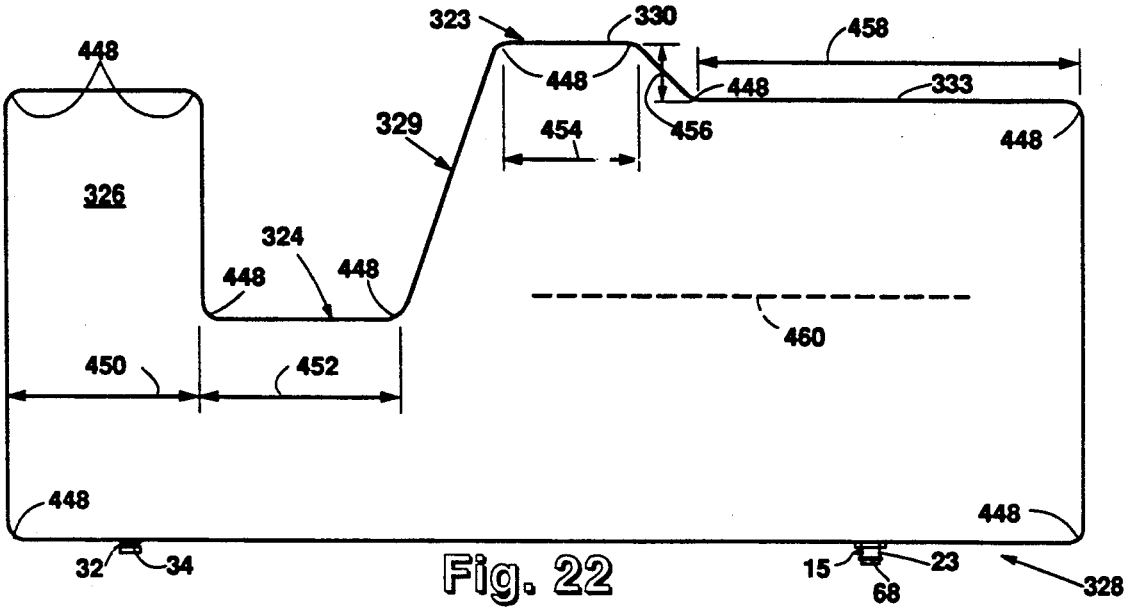

FIG. 22 is an end view of one of the air bags for use on the low air loss bed of FIG. 1.

Figure 23:
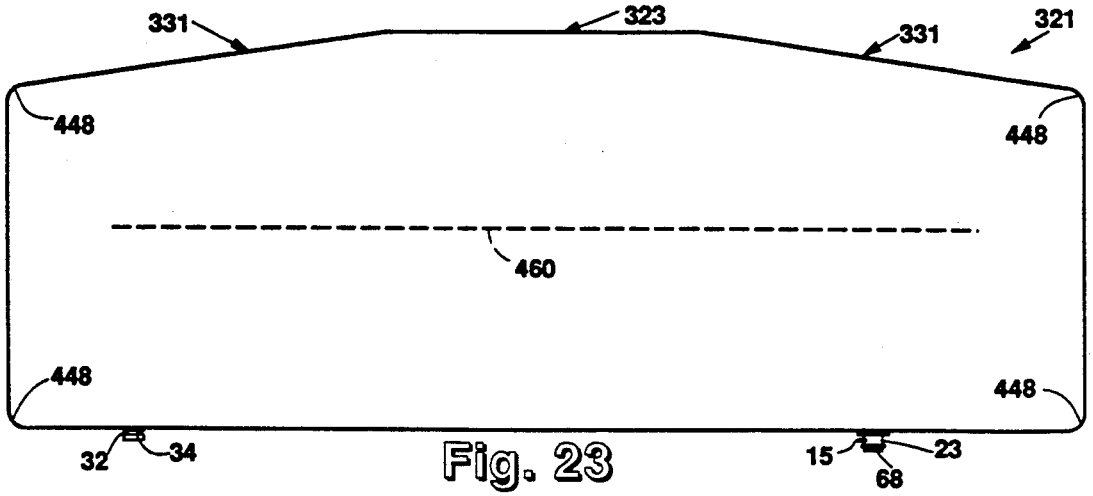

FIG. 23 is an end view of another one of the air bags for use on the low air loss bed of FIG. 1.

Figure 24:
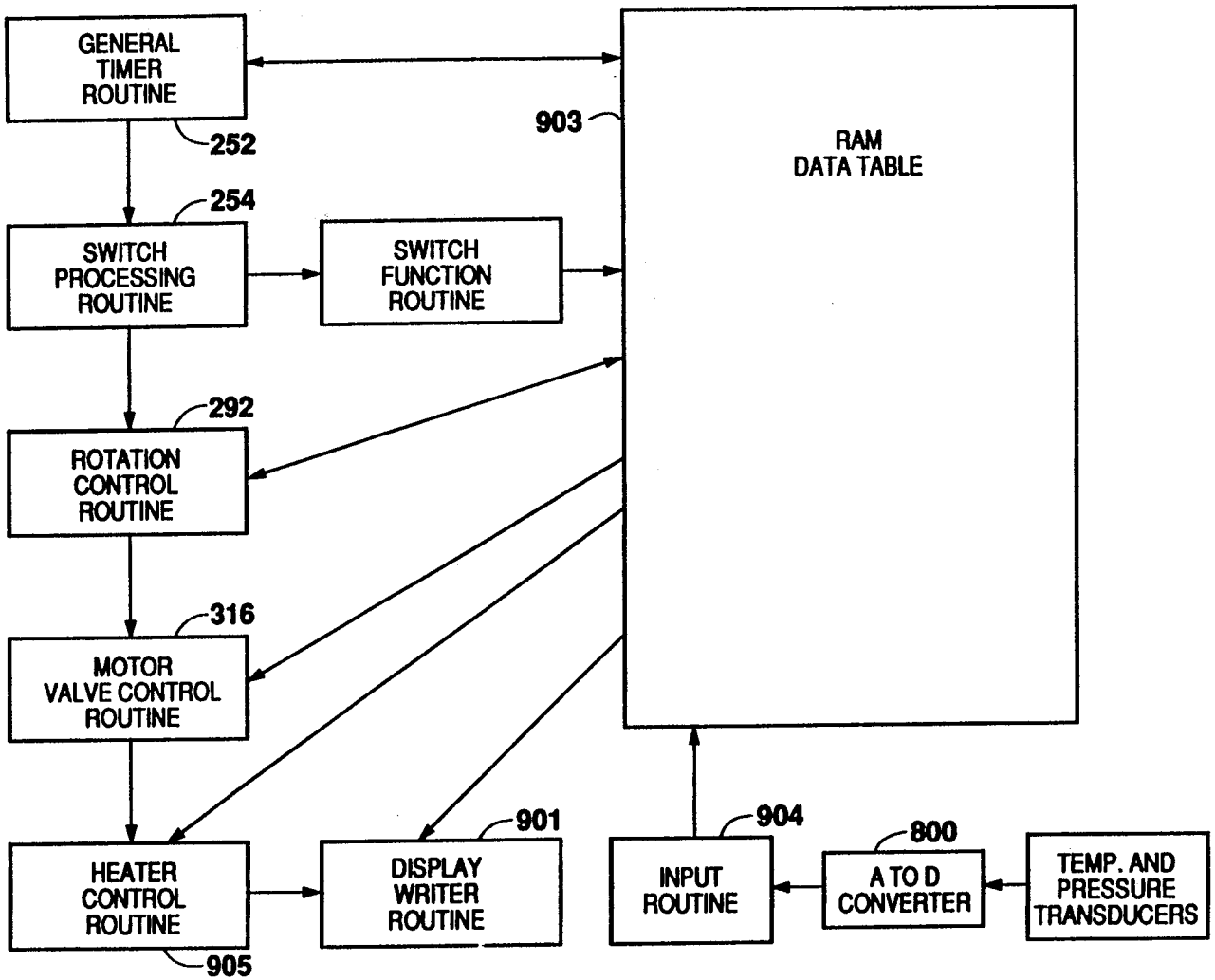

FIG. 24 is a general diagrammatic description of the control software for controlling the operation of the low air loss bed of FIG. 1.

DETAILED DESCRIPTION OF THE PREFERRED EMBODIMENTS

Referring to FIG. 1, there is shown a bed 10 including a frame 12. The frame 12 is comprised of a plurality of sections 14', 14'', 14''' and 14'''', hinged at the points 44', 44'' and 44''', and end members 16. Cross-members 18 (FIGS. 6 and 7) and braces 19 (FIG. 7) are provided for additional rigidity. The frame 12 is provided with headboard 20 at one end and a foot board 21 at the other end. The respective head 20 and foot 21 boards are actually constructed of two boards, 20' and 20'', and 21' and 21'', respectively, which are stacked one on top of the other by the vertical slats 25 on which the boards 20', 20'', 21' and 21'' are mounted.

A separate sub-frame, indicated generally at reference numeral 27 in FIGS. 6 and 7, is mounted on a base 22 comprised of longitudinal beams 24, cross-beams 26 and cross-member 28 by means of a vertical height adjustment mechanism as will be described. The base 22 is mounted on casters 30 at the corners of the base 22. A foot pedal 42 is provided for braking and steering the casters 30.

Sub-frame 27 is comprised of cross beams 29, hoop brace 35, and longitudinal beams 31 (see FIGS. 6 and 7). Sub-frame 27 is provided at the corners with uprights 33, having tabs 33' thereon, for mounting of IV bottles and other equipment. Means is provided for raising and lowering the sub-frame 27 relative to the base 22 in the form of a conventional vertical height adjustment mechanism, not all of the details of which are shown. Height is adjusted by rotation of an axle under influence of a power screw, hidden from view in FIG. 7 by drive tunnel beam 37, which is powered by a motor which is also hidden from view. Power is transferred from the power screw to the axle by means of eccentric levers, the axle of which is journaled in and hidden by drive tunnel beam 37. Sub-frame 27 rises on levers which are pivotally mounted to the cross-beams of base 22. The levers and the members on which they are mounted are hidden from view in FIGS. 6 and 7 by cross beam 29.

The section 14'' of frame 12 is mounted to the longitudinal beams 31 of sub-frame 27 by support members 41 (see FIG. 6). The section 14' of frame 12, with the head baseboard 52 thereon, and the section 14'''' of frame 12, with foot baseboard 46 thereon, pivot upwardly from the horizontal at the hinges 44' and 44'''', respectively. The purpose of that pivoting is to provide for the adjustment of the angle of inclination of the various parts of the body of the patient, and the details of that pivoting are known in the art and are not shown for purposes of clarity, although the motors are located within the boxes shown at 45 and are controlled by the switches 233, 235, 236, 237, 238, and 239 on control panel 346, or from the redundant controls on bed hand control 368 (see FIG. 14), and the circuitry for those functions is contained within box 43 (FIG. 7), which is shown schematically at reference numeral 367 (see FIG. 14), and is explained in more detail below.

Supports 17 are provided on the cross member 18 under head baseboard 52 which rest on the longitudinal beams 31 of sub-frame 27 when head baseboard 52 is horizontal. When foot baseboard 46 is raised (FIG. 7), cross-bar 47 rises therewith by means of the pivoting connection created by cross-bar 47 and the notches 49 in brace 19 (cross-bar 47 is shown detached from braces 19 in FIG. 7 for purposes of clarity). The sets of notches 49 provide means for adjusting the height to which cross-bar 47 can be raised, foot baseboard 46 pivoting upwardly on brackets 51 which are pivotally mounted to the longitudinal beams 31 of sub-frame 27. The tips 53 of cross-bar 47 rest on longitudinal beam 31 when foot baseboard 46 is lowered to the horizontal.

Side rails 81 are mounted to brackets 83 (see FIG. 6) which are pivotally mounted to the mounting brackets 85 mounted on the underside of head baseboard 52. Side rails 87 are mounted to brackets 89 (see FIG. 7), and brackets 89 are pivotally mounted to the mounting brackets 91. Mounting brackets 91 are affixed to the braces 19 on the underside of foot baseboard 46.

Figure 2:
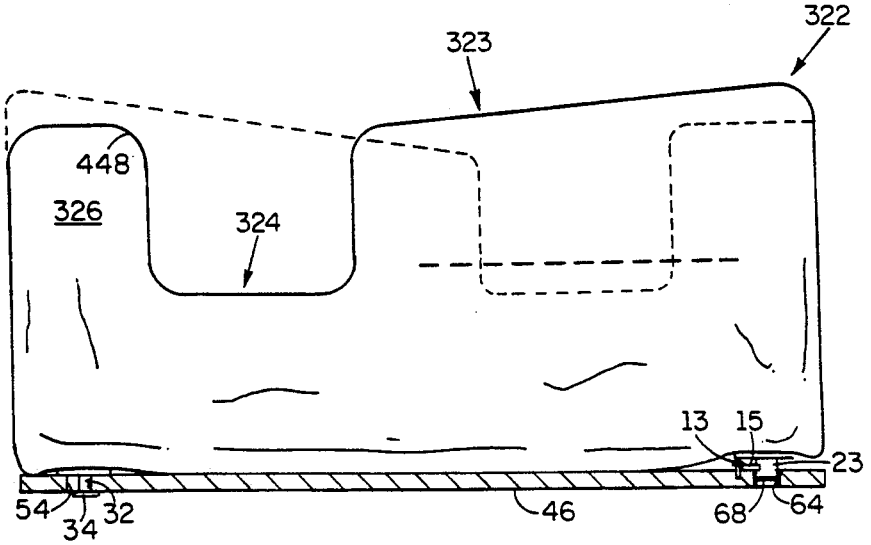

The frame 12 is provided with a feet baseboard 46, a leg baseboard 48, a seat baseboard 50 and a head baseboard 52 (shown in shadow lines in FIG. 3), each being mounted to the corresponding section 14', 14'', 14''' and 14'''' of the frame 12 by means of rivets 54 (see FIG. 11). Means is provided for releasably securing the air bags 58 to the low air loss bed 10. Referring to FIGS. 2, 4, and 5, there is shown a presently preferred embodiment of that releasable securing means. In FIGS. 4 and 5, there is shown a portion of the feet baseboard 46, which is provided with holes 64 therethrough which are alternating and opposite each other along the length of the feet baseboard 46, as well as leg baseboard 48, seat baseboard 50 and head baseboard 52. Every other hole 64 is provided with a key slot 11 for receiving the post 32, having retainer 34 mounted thereon, which projects through the bottom surface 79 of air bag 58, the flange 71 of which is retained between patch 69, which is stitched to the bottom surface 79 of air bag 58, and the bottom surface 72. Air bag 58 is shown cutaway and in shadow lines in FIG. 5 for purposes of clarity. Air bag 58 is also provided with a nipple 23 of resilient polymeric plastic material having an extension tab 15 integral therewith. To releasably secure the air bag 58 to feet baseboard 46, or any of the other baseboards 48, 50, or 52, post 32 is inserted through hole 64 until retainer 34 has emerged from the bottom thereof. Post 32 is then slid into engagement with key slot 11 and retainer 34 engages the bottom side of feet baseboard 46 around the margin of hole 64 to retain air bag 58 in place on feet baseboard 46. Nipple 23 is then inserted into the hole 64 opposite the hole 64 having key slot 11 therein and rotated until extension tab 15 engages the bottom of the head of flat head screw 13 to help secure nipple 23 in place.

In an alternative embodiment, the baseboards 46, 48, 50 and 52 are provided with means for releasably securing the air bags 58 to the low air loss bed 10 in the form of male snaps 56 (FIG. 11) along their edges. The air bags 58 are provided with flaps 60, each of which is supplied with female snaps 62 which mate with male snaps 56. Flaps 60 are alternatively provided with a strip of VELCRO tape 55, and the edges of baseboards 46, 48, 50 and 52 are provided with a complementary strip of VELCRO hooks 57, to secure each air bag 58 in place. Alternatively, flap 60 and baseboards 46, 48, 50 and 52 are provided with both VELCRO and snap fastening means.

The air bags 58 are substantially rectangular in shape, and are constructed of a coated fabric or similar material through which water vapor can move, but which water and other liquids will not penetrate. The fabric sold under the trademark "GORE-TEX" is one such suitable material. The air bags 58 can include one or more outlets for the escape of the air with which they are inflated or they can be constructed in a "low air loss" conformation.

Referring to FIGS. 1 and 2, air bags are shown of different configuration according to their location on the frame 12 of bed 10. For instance, the air bags mounted to the leg baseboard 48 and seat baseboard 50 are designated at reference numeral 322. Air bags 321, 322, 325 and 328 are constructed in the form of a substantially rectangular enclosure, at least the top surface 323 of which is constructed of water vapor permeable material such as described above. Air bags 321, 322, 325 or 328 are provided with means for connecting the inside of that enclosure to a source of gas, such as the blower 108, to inflate the enclosure with gas in the form of the nipple 23 (see FIG. 2) which extends through the baseboard 50 into the seat gas manifold 80 mounted thereto. Air bag 321, 322, 325 or 328 is also provided with means for releasably securing the enclosure to the low air loss bed 10 in the form of the post 32 and retainer 34 described above. Means is provided for moving a patient 348 supported on air bags 322, 325 or 328 toward one side of frame 12 when air bags 322, 325 or 328 are inflated and for retaining the patient 348 on the top surface 323 of air bags 322, 325 or 328 when patient 348 is rolled or rocked towards one side of frame 12 or the other (see FIGS. 10A–10D). The means for moving patient 348 supported on air bags 322, 325 or 328 toward one side of frame 12 when the air bags 322, 325 or 328 are inflated comprises a cutout 324 in the top 323 of the substantially rectangular shape of each of the air bags 322, 325 or 328.

Each air bag 322, 325 or 328 is also provided with means for retaining a patient 348 on the top surface 323 of the air bag 322, 325 or 328 when patient 348 is rolled toward the side of frame 12 by the inflation of air bags 322, 325 or 328 in the form of a pillar 326 which is integral with each air bag 322, 325 or 328 and which, when inflated, projects upwardly to form the end and corner of the substantially rectangular enclosure of air bag 322, 325 or 328. The means for retaining patient 348 on the top 323 of air bags 322, 325 or 328 can also take the form of a large foam cushion (not shown) mounted to side rails 81 and 87 on both sides of bed frame 12. That cushion can be detachably mounted to side rails 81 and 87, or can be split so that a portion mounts to said rail 81 and a portion mounts to side rail 87. The air pressure in air bags 322, 325 or 328 is then adjusted, as will be explained, until patient 348 is rocked gently against that foam cushion on one side of bed frame 12 and then back toward the other side of bed frame 12.

As shown in FIG. 1, a plurality of air bags 58, 321, 322, 325 and/or 328 is mounted transversely on the frame 12 of bed 10. The air bags 322, 325 or 328 are divided into a first set in which the pillar 326 and cutout 324 are closer to one side of bed frame 12 than the other and a second set of air bags 322, 325 or 328 in which the pillar 326 and cutout 324 are closer to the second side of the bed frame 12. The air bags 322, 325 or 328 of the first set and the air bags 322, 325 or 328 of the second set alternate with each other along the length of baseboards 46, 48, 50, and 52. As will be explained, the first set of air bags 322, 325 or 328 is inflated with air from blower 108, thereby causing the patient 348 (not shown in FIG. 1, see FIGS. 10A–10D) supported on the air bags 322 to be rolled toward the first side of bed frame 12 and then deflated while the second set of air bags 322, 325 or 328 is inflated, thereby moving the patient 348 toward the other side of bed frame 12.

Figure 10C:
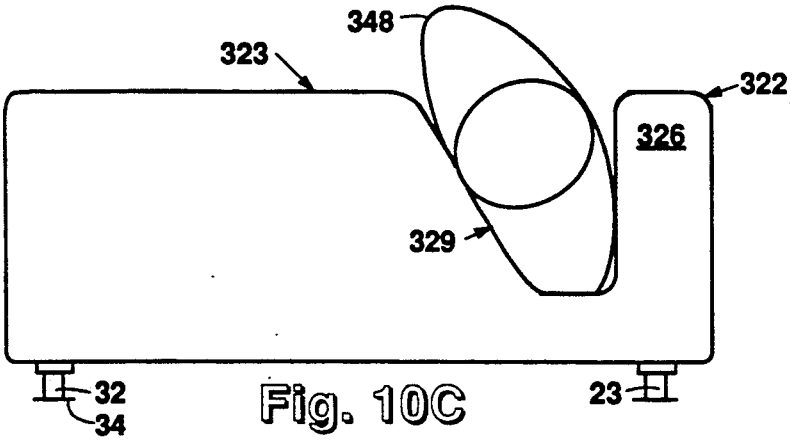
Figure 10D:
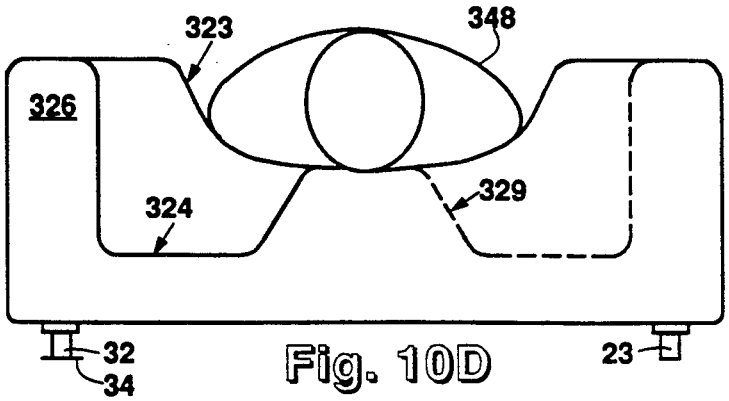

The air bags 321 which are mounted on head baseboard 52 are provided with a flat top surface 323 so that the head of patient 348 is retained in a relatively constant position while the body of patient 348 is alternately rolled first toward one side of the bed frame 12 and then back toward the other side of bed frame 12. Referring to FIG. 23, an air bag 321 is shown for use under the head of patient 348. Air bag 321 is substantially rectangular in shape, but is provided with a slanted top surface 323 in the area 331 adjacent corners 448. The height of air bag 321 is less than the height of air bags 58, 322, 325 and 328 because when patient 348 lies upon air bags 58, 322, 325 and/or 328, the heavier portions, i.e., the portions of the body other than the head, sink into those air bags 58, 322, 325 and/or 328 as shown in FIG. 10D. When the patient 348 sinks into air bags 58, 322, 325 and/or 328, the head rests evenly on air bags 321 because the head does not sink into air bags 321 as far as the other portions of the body.

The air bags 328 mounted on the foot baseboard 46 and the air bags 328 mounted on a portion of leg baseboard 48 are also provided with a cutout 324 and pillar 326 as described for the air bags 322. Additionally, air bags 328 are provided with a hump 330 so that the legs of patient 348 are relatively restrained from movement during the alternate back and forth movement of patient 348, thereby helping to retain the patient 348 on the top surface 323 of air bags 58, 321, 322, 325 and 328 as well as helping to distribute the pressure exerted against the skin of patient 348 over an increased area.

Referring to FIG. 22, there is shown a side view (by "side view," reference is made to the air bag itself; if the air bag 328 (or 321 or 322) were mounted to bed 10, the view would be an end view of the bed) of an air bag 328 having hump 330 formed in the top surface 323 thereof. As can be seen, when air bag 328 is inflated, hump 330 and pillar 326 project upwardly to help prevent the rolling of patient 348 too far to one side of bed frame 12 or the other. An alternative construction of air bag 322 is shown at reference numeral 325 in FIG. 21. Air bag 325 is provided with cutout 324 of approximately the same depth as the cutout 324 of air bags 322 and 328, but the slope of the top surface 323 in the area 327 is less than the slope of the top surface 323 in the area 329 of air bags 322 and 328. Air bag 325, in conjunction with the adjustment of the air pressure in the air bags 58, 321, 322 and/or 328, can be used under different portions of the body of patient 348 to increase or decrease the extent and speed with which patient 348 is rolled from one side of bed frame 12 to the other. For instance, air bag 325 is particularly well-suited for use under the shoulders of a patient 348.

As noted above, all of the air bags 58, 321, 322, 325 and 328 are substantially rectangular in shape with dimensions of approximately 18×39 inches. Each is provided with a baffle 460 attached to side walls 61 which holds the side walls 61 against bowing when the air bag 58, 321, 322, 325 or 328 is inflated. Each of the corners 448 has a radius of curvature of approximately three inches, and the depth of cutout 324 is approximately ten inches. The dimension of pillar 326 of air bags 325 and 328 in the direction shown by line 450 is approximately seven inches, as is the dimension of cutout 324 in the direction shown by line 452. The dimension of pillar 326 of air bag 322 in the direction shown by line 451 is approximately twelve inches. The dimension of the top surface 323 of air bag 325 along line 453 is approximately twenty inches, and that top surface 323 drops off into cutout 324 in a curve 455 of approximately a six inch radius. Referring to FIG. 2, the dimension of the top surface 323 along line 458 is approximately nineteen inches. The dimension of hump 330 on air bag 328 in the direction shown by line 454 is approximately five inches, and in the direction shown by line 456, the dimension is approximately two inches. The dimension of surface 333, as shown by line 458 is approximately fourteen inches.

In an alternative construction for attaching the air bags 58, 322 and 328 to the bed 10 (shown in FIG. 11), each air bag 58 (it should be understood throughout the specification that, when reference is made to an air bag 58, the air bag could also be an air bag 321, 322, 325 or 328) is provided with a flanged nipple 70, the flange 71 of which is retained between the bottom 72 of the air bag 58 between a patch 74 and the bottom 72 of the air bag. As described below, each air bag 58 is mounted separately on the baseboards 46, 48, 50, and 52 by snapping the female snaps 62 in the flaps 60 of each of the air bags 58 over the male snaps 56 on the edges of the baseboards 46, 48, 50, and 52 or with the VELCRO tape 55 and hooks 57, or both. When so positioned, the flanged nipple 70 on the bottom inside 72 of the air bag 58 projects through the holes 64 and 64' in the baseboards 46, 48, 50, or 52 over which the air bags 58 are positioned. An O-ring 68 is provided in a groove (not numbered) around each of the flanged nipples 70 to insure a relatively gas-tight fit between the flanged nipple 70 and the corresponding baseboard 46, 48, 50, or 52 through which the flanged nipples 70 project.

The use of individual air bags 58, 321, 322, 325 or 328 rather than a single air cushion allows the replacement of individual bags should one develop a leak, need cleaning or otherwise need attention. When it is desired to remove an individual air bag 58, 321, 322, 325 or 328 from its respective baseboard 46, 48, 50, or 52, post 32 is slid out of key slot 11 and retainer 34 and post 32 are removed from hole 64. Nipple 23 is then rotated until extension tab 15 rotates out of engagement with screw 13 and is pulled firmly to remove it from hole 64. In the case of air bag 58, female snaps 62 at each end of the air bag 58 are disengaged from the male snaps 56 (or the VELCRO strips peeled away from each other) on the edges of baseboards 46, 48, 50 or 52, and the air bag 58 is removed by twisting flanged nipple 70 up and out of the hole 64 in the baseboard 46, 48, 50, or 52. Removal can even be accomplished while the patient is lying on the inflated air bags 58, 321, 322, 325 or 328.

For additional security in holding air bags 58 onto baseboards 46, 48, 50 and 52, and to help insure a gas-tight fit between flanged nipple 70 and the respective baseboards 46, 48, 50 or 52 through which it projects, spring clip 73 (see FIG. 11) is inserted through nipple 70 of air bag 58. To insert the nipple 70 into hole 64, the hoop portion 75 of spring clip 73 is squeezed (through the fabric of air bag 58), causing the flanges 77 on the ends of the shank portion 101 of spring clip 73 to move toward each other so that they can enter the hole 64. Once inserted through the hole 64, flanges 77 spring apart, and will not permit the removal of nipple 70 from hole 64 without again squeezing the hoop portion 75 of spring clip 73.

Referring to FIG. 6, there is shown an end view of a bed constructed according to the present invention. Brace 102 is secured to the cross beam 29 of sub-frame 27 by means of bolts 104. Blowers 108 are mounted to the brace 102 by means of bolts 110 through the mounting plates 112 which are integral with the blower housing 116. A gasket, piece of plywood or particle board (not shown), or other sound and vibration dampening material is interposed between mounting plates 112 and brace 102. A strip of such material (not shown) can also be inserted between brace 102 and cross beam 29. The blowers 108 include integral permanent split capacitor electric motors 114. When motors 114 are activated blowers 108 move air out of the blower housings 116, through the blower funnels 118 and up the blower hoses 120 to the air box funnels 122 and on into the air box 124 (see FIGS. 3 and 6).

Blowers 108 receive air from filter box 96 through hoses 98 (see FIG. 3). Filter box 96 is retained within a frame 100 (see FIG. 6) for ease in removal. Frame 100 is mounted to frame 27 and is, for the most part, blocked from view by cross-beam 26 of base 22 and cross beam 29 of frame 27 in FIG. 6. The second blower 108 is provided to increase the volume which is delivered to the air bags 58, thereby increasing the air pressure within air bags 58. A cover (not shown) lined with sound absorbing material can also be provided to enclose blowers 108 and thereby reduce noise.

The air control box 124 is an airtight box mounted on the underside of head baseboard 52 by brackets 125, the details of which are shown in FIGS. 8, 9A, and 9B. The front of air box 124 is provided with a manifold assembly 126. Manifold assembly 126 is provided with a manifold plate 145 having holes (not numbered) therein for connection to a means for changing the amount of air supplied to the air bags 58 mounted to baseboards 46, 48, 50 and 52 in the region of the feet, legs, seat, back, and head, respectively. Gasket 115 prevents the escape of air from between air box 124 and manifold plate 145. In a presently preferred embodiment, the means for changing the amount of air supplied to the air bags 58 takes the form of a plurality of valves, indicated generally at reference numerals 128, 130*a* and 130*b*, 132*a* and 132*b*, and 134*a* and 134*b* (see also FIG. 3). Each of the valves 128, 130*a* and 130*b*, 132*a* and 132*b*, and 134*a* and 134*b* is provided with a motor 138 having a nylon threaded shaft 139 (see FIGS. 8, 9A and 9B) mounted on the drive shaft (not numbered) of each motor 138 and held in place by set screw 149 in collar 148. Plug 140 moves rotatably in and out along the threaded shaft 139 when limit pin 141 of plug 140 engages one or the other of the supports 142 which are immediately adjacent that particular plug 140 and which hold the motor mounting bracket 143 to the back of the full inflate plate 144.

Full inflate plate 144, having openings 202 therein forming part of valves 128, 130*a* and 130*b*, 132*a* and 132*b*, and 134*a* and 134*b*, is mounted to the back of the manifold plate 145 by hinges 146 (see also FIGS. 9A and 9B). A gasket 147 is provided to prevent the escape of air from between the full inflate plate 144 and manifold plate 145. The motors 138 are not provided with limit switches, the movement of plug 140 back and forth along the threaded shaft 139 of each motor 138 being limited by engagement of plug 140 with the opening 202 as plug 140 moves forward and by the engagement of the back side of plug 140 with collar 148 as plug 140 moves back on threaded shaft 139. An 0-ring 204 is provided on plug 140 which is compressed between plug 140 and opening 202 as plug 140 moves forward into opening 202. Compression continues until the load on motor 138 is sufficient to cause it to bind and stop. The 0-ring 206 which is provided on collar 148 operates in similar fashion when engaged by the back side of plug 140.

The binding of motors 138 by the loading of 0-rings 204 and 206 facilitates the reversal of the motors 138 and direction of travel of plug 140 along threaded shaft 139 because threaded shaft 139 is not bound. Threaded shaft 139 is free to reverse direction and turn such that the load created by the compression of 0-rings 204 or 206 is released by the turning of threaded shaft 139, and plug 140 will rotate with threaded shaft 139 until limit pin 141 contacts support 142, stopping the rotation of plug 140 and causing it to move along shaft 139 as it continues to turn.

A dump plate 150 is mounted on the outside of manifold plate 145 by means of hinges 151 (see FIGS. 9A and 9B). A gasket 106 is provided to prevent the escape of air from between the manifold plate 145 and the dump plate 150. The dump plate 150 is provided with couplers 153, the interiors of which are continuous with the holes in manifold plate 145 when dump plate 150 is in the position shown in FIGS. 8, 9A, and 9B, for connection of the appropriate bed frame gas supply hoses 174, 176*a* and 176*b*, 178*a* and 178*b*, and 182*a* and 182*b*, as will be explained.

Block 154 is attached to dump plate 150 by means of screws 155, and serves as a point at which the cable 156 can be anchored, by means of nut 157, so that a line 158 can slide back and forth within cable 156 to allow the dump plate 150 to be selectively pivoted away from manifold plate 145 on hinge 151. The line 158 is secured to the manifold plate 145 by the threaded cable end and locknut 159. Line 158 is secured at its other end to the bracket 183 mounted on tube 190 (see FIG. 7). Bed frame 12 is provided with quick dump levers 165 on both sides thereof, the quick dump levers 165 being connected by tube 190 so that both levers 165 provide a remote control for operation of dump plate 150 by causing the movement of line 158 through cable 156. When either of quick dump levers 165 is moved from the position shown in FIG. 7, eccentric lever arm 181 pulls on line 158, cable 156 being anchored on bracket 183, so that line 158 moves through cable 156. The details of the anchoring of cable 156 and movement of line 158 therethrough under the influence of lever arm 181 are the same as those for the anchoring of cable 160 and movement of line 162 therethrough under the influence of lever arm 185 (see below). Movement of line 158 causes dump plate 150 to pivot away from manifold plate 145, allowing the air in air bags 58 to escape through manifolds 76, 78, 80, 82 and 84 and bed frame gas supply hoses 174, 176*a*, 178*a*, 180*a*, 176*b*, 178*b*, and 180*b* to the atmosphere from the opening thus created between manifold plate 145 and dump plate 150 so that air bags 58 will rapidly deflate. A coil spring 201' encloses line 158 within bores (not numbered) in dump plate 150 and manifold plate 145 to bias dump plate 150 and manifold plate 145 apart.

As is best shown on FIGS. 8 and 9B, a separate cable 160 passes through manifold plate 145 in threaded fitting 161 so that line 162 can slide back and forth therein. The line 162 is anchored in the full inflate plate 144 by means of nut 163, which allows the full inflate plate 144 to pivot away from the manifold plate 145 on hinge 146. Pivoting of full inflate plate 144 away from manifold plate 145 in this manner removes full inflate plate 144, motor mounting bracket 143, and all other parts mounted to those parts, from the flow of air to allow the unrestricted entry of the air in air box 124 into the couplers 153 of valves 128, 130*a* and 130*b*, 132*a* and 132*b*, and 134*a* and 134*b* and on into bed frame gas supply hoses 174, 176*a* and 176*b*, 178*a* and 178*b*, and 182*a* and 182*b*, resulting in the rapid and full inflation of air bags 58 to raise the patient 348 to the position shown in FIG. 10B to facilitate patient transfer or other needs. A coil spring 201 encloses line 162 in a bore (not numbered) in manifold plate 145 and full inflate plate 144 to bias manifold plate 145 apart from full inflate plate 144.

Line 162 is anchored at its other end on lever arm 185 (FIG. 7) which is attached to the bar 195 upon which full inflate knob 193 is mounted. Bed frame 12 is provided with full inflate knobs 193 on both sides thereof, the full inflate knobs 193 being connected by bar 195 so that both control the movement of line 162 through cable 160. Cable 160 is affixed to bracket 187 by threaded cable end 199, which is mounted on the DELRIN bearing 209 which is integral with support member 210 and which receives bar 195 so that rotation of full inflate knobs 193 causes line 162 to slide therein, pivoting full inflate plate 144 on hinge 146. The weight of motors 138, supports 142 and motor mounting bracket 143 bias full inflate plate 144 toward the position in which full inflate plate 144, motor mounting bracket 143, and the parts mounted thereto, are removed from the flow of gas into the couplers 153 of valves 128, 130*a* and 130*b*, 132*a* and 132*b*, and 134*a* and 134*b*. This bias allows knobs 193 to act as a release such that either of knobs 193 need only be turned enough to move the connection between line 162 and lever arm 185 out of its over center position, at which point gravity causes the plate 144 to open. Referring to FIG. 10B, patient 348 is shown lying on air bags 322 (and/or 58, 321, 325 or 328) after full inflate plate 144 is opened. When knobs 193 are returned to their initial position, lever arm 185 turns to the point at which the connection between line 162 and lever arm 185 is rotated past 180° from the point at which line 162 approaches bar 195, i.e., over center. As noted below, microprocessor 240 includes an alarm buzzer (not shown), and switches (not shown) can be provided for activating that alarm when either of knobs 193 or levers 165 are used to inflate or deflate air bags 58, 321, 322, 325, and/or 328 respectively.

Air enters the air box 124 through air box funnels 122 in back plate 121 (FIG. 3). Air box funnel 122 is provided with a one-way flapper valve, shown schematically at reference numeral 117, so that air will not escape from the air box 124 when only one blower 108 is being operated. The air box 124 is provided with a heating strip indicated schematically at reference numeral 172. Heating strip 172 is mounted in bulkhead 133 in air box 124, effectively partitioning air box 124 into two compartments. Because air enters the air box 124 in one compartment (i.e., behind heating element 172) and leaves the air box 124 from the other compartments, a flow of air must pass through the space 135 between bulkhead 133 in which heating element 172 is mounted, being mixed and heated in the process.

Referring to FIG. 3, blowers 108 are switched on, forcing or pumping air (or other gases) received from filter box 96 through hoses 98 up the blower hoses 120, through one-way valves 117, and into air box 124. A valve 109 is provided to provide increased control of the air pressure in air bags 58, 321, 322, 325 and 328 and to seal off one of the blowers 108 so that the bed 10 can be operated on one of the blowers 108 or on blower 432 (see FIG. 7). Valve 109 is also used to restrict the flow of air from one of the blowers 108 when both blowers 108 are operating, thereby providing additional adjustability in air pressure.

The air escapes from the air box 124 through valves 128, 130*a* and 130*b*, 132*a* and 132*b*, and 134*a* and 134*b* into the respective bed frame gas supply hoses, 174, 176*a* and 176*b*, 178*a* and 178*b*, and 182*a* and 182*b*. Bed frame gas supply hoses 174, 176*a* and 176*b*, 178*a* and 178*b*, and 182*a* and 182*b* route the air to the manifolds 76 and 76', 78 and 78', 80 and 80', 82 and 82', and 84. Bed frame gas supply hoses 178*a* and 178*b* are connected to seat gas manifolds 78 and 78', which are connected by bed frame gas supply hoses 180*a* and 180*b* to leg gas manifold 78 and 78'. Bed frame gas supply hoses 182*a* and 182*b* route air to back gas manifolds 82 and 82', respectively. Bed frame gas supply hose 174 routes air to head gas manifold 84. Each of the gas manifolds 76 and 76', 78 and 78', 80 and 80', 82 and 82', and 84 is mounted to the underside of the baseboards 46, 48, 50 and 52, feet baseboard 46 having gas manifolds 76 and 76' mounted thereto, leg baseboard 48 having gas manifolds 78 and 78' mounted thereto, and seat baseboard 50 having gas manifolds 80 and 80' mounted thereto. The head baseboard 52, and its corresponding section 14'''' of frame 12, is provided with two back gas manifolds 82 and 82' and head gas manifold 84.

Because the feet baseboard 46 extends beyond the end member 16 of the frame 12 at the foot of the bed, T-intersects 86 and 86' are provided from the feet gas manifolds 76 and 76', respectively, to route feet extension hoses 88 and 88' to the holes 64 and 64' at the extreme ends of the feet baseboard 46 (see FIGS. 3, 7 and 11). Clamps 65 are provided to hold the feet extension hoses 88 and 88' in place on the nipples 23 in holes 64 and 64' and on T-intersects 86 and 86'. The head baseboard 52 likewise extends beyond the end member 16 of frame 12 at the head end of the bed (FIGS. 3 and 6), and T-intersect 92 is provided from the head gas manifold 84 to provide air to the hole 64 at the extreme end of the head baseboard 52 by means of the head extension hose 94. A clamp 65 is provided to retain head extension hose 94 on T-intersect 92 and on the receptacle 66 in hole 64.

Air enters the gas manifolds 76 and 76', 78 and 78', 80 and 80', 82 and 82', and 84 from each respective bed frame gas supply hose 174, 176*a* and 176*b*, 178*a* and 178*b*, 180*a* and 180*b*, or 182*a*, and then passes down the length of each gas manifold 76 and 76', 78 and 78', 80 and 80', 82 and 82', or 84. Air escapes from the gas manifolds 76 and 76', 78 and 78', 80 and 80', 82 and 82', or 84 into the air bags 58 through the holes 64 and 64' in the baseboards 46, 48, 50 and 52, thereby inflating the air bags 58.

The holes 64 and 64' through base boards 46, 48, 50 and 52 into the respective air bags 322, 325 and 328 are staggered down the length of the frame 12 of bed 10. In other words, every other hole 64, or 64' is provided with a key slot 11 (see FIG. 4). Air bags 322, 325 and 328 are provided with a single nipple 70 or 23, respectively and a post 32 with retainer 34 thereon for engagement of key slot 11 in hole 64 or 64' at the other end thereof. The air bags 322, 325 and 328 alternate in their orientation on baseboards 46, 48, 50 and 52, resulting in about half the air bags 322, 325 and 328 being oriented with nipple 70 or 23 closer to one side of bed frame 12 than the nipple 70 or 23 of the other half of the air bags 322, 325 or 328 mounted thereon.

Because each of the bed frame gas supply hoses 174, 176*a* and 176*b*, 178*a* and 178*b*, 180*a* and 180*b*, and 182*a* and 182*b* is continuous with a corresponding gas manifold 76 and 76', 78 and 78', 80 and 80', 82 and 82', or 84, the amount of air supplied to each gas manifold 76 and 76', 78 and 78', 80 and 80', 82 and 82', or 84 can be varied using the valves 128, 130*a* and 130*b*, 132*a* and 132*b*, and 134*a* and 134*b* on the air box 124. Since each of the valves 128, 130*a* and 130*b*, 132*a* and 132*b*, and 134*a* and 134*b* controls the amount of air supplied to one of the manifolds 76 and 76', 78 and 78', 80 and 80', 82 and 82', or 84, each valve 128, 130*a* and 130*b*, 132*a* and 132*b*, 134*a* and 134*b* controls the amount of air supplied to the set of air bags 322, 325 or 328 individual gas manifold 76 and 76', 78 and 78', 80 and 80', 82 and 82', or 84.

Also shown in FIGS. 3 and 7 is a portable power unit, or transporter, indicated generally at 426. Portable power unit 426 is comprised of case 428, which encloses batteries 430, blower 432 and battery charger 434, and hose 436. Hose 436 is provided with a releasable coupler 438 which mates with the coupler 440 of the hose 442 which is mounted on sub-frame 27 and which connects to air box 124 through funnel 444. Brackets 446 are mounted to subframe 27 for releasably engaging the case 428 of portable power unit 426. Portable power unit 426 provides air pressure to support a patient when an electrical outlet is unavailable, for instance, during patient transport.

As will be explained, means is provided for alternately inflating first the air bags 322 and 328 connected to back, seat, leg and feet gas manifolds 76, 78, 80 and 82, respectively, and then deflating those air bags while inflating the air bags 322 and 328 connected to back, seat, leg and feet gas manifolds 76', 78', 80' and 82'. The alternating inflation and deflation of the first set of air bags 322 and 328 and the second set of air bags 322 and 328 causes a patient 348 supported thereon to be alternately rocked in one direction and then the other (see FIGS. 10A-10D) because of the alternating arrangement of the cutouts 324 on air bags 322 and 328.

To accomplish the rocking of patient 348, the appropriate air bags are alternately inflated and deflated under microprocessor control. Referring to FIG. 3, valves 130*a*, 132*a*, and 134*a* feed air to manifolds 82, 80, 78 and 76. These manifolds feed air to a first set of air bags 322, 325 and 328 having their pillars 326 and cutouts 324 closer to a first side of bed frame 12. Similarly, valves 130*b*, 132*b* , and 134*b* feed air manifolds 82', 80', 78' and 76' which feed air to a second set of air bags 322, 325 and 328 having their pillars 326 and cutouts 324 closer to the second side of bed frame 12. Valve 128 feeds air to manifold 84 which supplies air to the air bags 321 supporting the head of patient 348. Pressures in each manifold can be controlled by microprocessor 240 by adjustment of the individual valves which supply air to each manifold. The software is programmed to move the patient sequentially to each of three positions corresponding to the pressures set by the operator. FIGS. 10A, 10C, and 10D show three such positions, which are sequentially stepped through by the software.

The hump 330 in air bags 328 provides a longitudinal barrier along the top surface of the air bags 328 such that one of the legs of patient 348 is retained on either side of the longitudinal barrier created by the humps 330 even during the alternating inflation and deflation of the bags 328. In this manner, the hump 330 prevents patient 348 from rolling too far to one side of the bed frame 12 or the other. Further, the legs of patient 348 do not slide and/or rub together while patient 348 is being alternately rolled from one side of the bed frame 12 to the other. It will be understood by those skilled in the art that the air bags 328 having the humps 330 therein can be replaced by air bags 321, 322, or 325 depending upon the type of therapy and the extent of motion desired for a particular patient.

The software operates on an internal interrupt basis. That is, the software idles until a specified number of clock pulses is received, at which point an interrupt signal is generated internally by microprocessor 240. When the software detects this internal interrupt, the various functional software modules shown in FIG. 24 are executed sequentially. Since microprocessor 240 is configured to generate the internal interrupt every fifty milliseconds, the functional software modules of FIG. 24 are executed every fifty milliseconds.

Referring now to FIG. 24, there is shown a block diagram of the functional software modules used to accomplish the control functions of the present invention. Initialization and power-down routines, as described below, are also present in the software but have been omitted from this diagram for simplicity. Also omitted are the various interrupt servicing routines. FIG. 24 merely depicts the application software which is executed every fifty milliseconds by microprocessor 240.

Some of the functional modules or routines of FIG. 24 will be described in greater detail below. What follows is an overview of how these routines are integrated to accomplish the objectives of the present invention.

RAM data table 903 is a block of memory which is used to store variables needed by the control software. Those variables include software timers, status flags, switch inputs, analog data inputs, target pressure values, and a target temperature value. Software timers are simply memory contents which are initialized with a specified value and then decremented every fifty milliseconds by general timer routine 252. Switch inputs are digital inputs received from the control panel or from various switches described elsewhere. The status of these switches are stored in RAM data table 903 so that spurious switch bounce conditions can be detected, as is described in greater detail below. Status flags are memory words used by the software to communicate to the software modules a certain status which affects how a software module is to operate. For example, a status flag is used to signify whether the bed is to be rotated to the left, right, or center. Status flags can be changed by external inputs or by the timing out of certain software timers. Analog data, corresponding to values received from pressure and temperature transducers, are also stored in RAM data table 903. Also, the target pressures and temperature, which the software attempts to maintain and is adjustable by operator input, are stored in RAM data table 903.

Upon receiving the aforementioned internal interrupt, the first module to be executed by microprocessor 240 is general timer routine 252. This routine decrements the various software timers and sets certain status flags which affect the operation of other modules when a timed out condition occurs. Next, switch processing routine 254 which scans all the digital inputs is executed. When a change is detected in a digital input, the appropriate switch function routine 284 is executed. As will be described below, those switch function routines update data in RAM data table 903 according to the type of switch input change detected.

After all the digital inputs have been scanned, rotation control routine 292 is executed. Rotation control 292 determines whether valves 128, 130*a* and 130*b*, 132*a* and 132*b* , or 134*a* and 134*b* need to be opened, closed, or maintained in their present position. To make that decision, rotation control routine 292 relies on analog data from the pressure transducers, target pressure values, and status flags which tell the routine which target pressure values to use. Rotation control routine 292 sets status flags which are then read by motor valve routine 316. Motor valve routine 316 actually drives the valve motors 138 according to the decisions made by rotation control routine 292. Those decisions are communicated to motor valve routine 316 by status flags.

Heater control routine 905 retrieves present and target temperature values from RAM data table 903, compares them, and either turns heater strip 172 on or off with a digital output. The last module to be executed as part of the internal interrupt driven loop is the display writer routine 901. This routine retrieves data from RAM data table 903 which is to be output to the control panel. Display writer routine 901 then drives the bar graph displays 356 of control panel 346 according to the data retrieved. Analog input routine 904 operates continuously according to external interrupts generated by an analog-to-digital converter shown schematically at reference numeral 800, but which is internal to control box 198 and, therefore, not shown elsewhere. Analog input routine 904 retrieves data from analog-to-digital converter 800 and updates the appropriate location in RAM data table 903.

Referring now to FIGS. 15–20, the programming of microprocessor 240 will be discussed. As shown in FIG. 15, the initialization of the program is at 242. Variable memory or RAM is cleared at step 244. Before internal or external interrupts are enabled, all RAM variable contents are zeroed and those requiring specific data, such as those stored in the electrically alterable ROM described below, are initialized at step 246. Data and direction registers for the four eight bit ports of microprocessor 240 are then initialized at step 248.

The control software then idles in loop 250 until it receives a 50 millisecond interrupt from the hardware interrupt timer internal to microprocessor 240. Microprocessor 240 then sequentially executes the subroutines 252, 254, 292 and 316, diagrammed in FIGS. 16-19. General timer subroutine 252 (see FIG. 16) decrements most of the software driven timers contained in the RAM, including the electrically alterable ROM power "ON" delay before erase timer, the cardiopulmonary switched "OFF" to the audible alarm "ON" delay timer, the audible beep silence timer, and the rotation timer. General timer subroutine 252 is entered from FIG. 15 at connector 253, and the first step 254 is to test to determine whether the power on/off pushbutton 851 (see FIG. 14) has been switched to the "OFF" position or the pause adjust buttons 728, 730 or 732 have been activated, a step which is required because the loop 250 runs at 50 msec intervals whenever main power cord 218 (see FIG. 12) is plugged into a power source (now shown). If either of those buttons 851 or 728, 730 or 732 have been activated, the subroutine 252 continues to step 259A, if not, the status of the rotation timer is checked at step 256, and if the target (zero) has not been attained, the timer is decremented at step 257, if target has been attained, the rotation mode is advanced to the next sequential rotation phase and the timer is re-initialized at step 258 with the respective time delay valve input by the operator using one of switches 728, 730 or 732 on control panel 346.

As will be described, temperature set switch 152 is used in conjunction with display 168 on control panel 346 (see FIG. 14) to set target temperature in air bags 321, 322, 325 and 328 by pressing and holding one or the other of switches 152A or 152B to increment or decrement the counter which advances the target temperature by an increment each time a selected number of 50 msec pulses have elapsed (or decreases by that same increment). If switch 152A or 152B has been activated by the operator, a test is made at step 259B to determine which switch was activated. If decrease/decrement switch 152B was activated, the counter is checked to determine whether the count is at minimum count at step 259C. If so, the subroutine advances to step 259, and if not, the counter is decremented at step 259D and the subroutine 252 continues to step 259. If the status check at step 259B indicates that the temperature increase increment switch 152 has been activated, the counter is checked to determine whether the count is at a maximum at step 259E. If so, subroutine 252 advances to step 259, and if not, the counter is incremented at step 259F and subroutine 252 then advances to step 259.

If the power "ON" delay timer is not zero at step 259, that timer is decremented at 260 until zero is attained, and the subroutine advances to the cardiopulmonary switched "OFF" to the audible alarm "ON" timer for similar processing at step 261. That timer is decremented at step 262 if the timer is not zero, and checked again at step 263. If the timer still has not expired, the alarm (not shown) in microprocessor 240 is activated at 264; if the timer has expired, the routine advances to the audible beep silence timer at 265. If that timer has not expired, the timer is decremented at 266, checked again at 267, and if still not expired, the alarm continues to be activated at 268. The general timer subroutine 252 is then exited when the last timer has been processed, and connects back into the control software at 270 (see FIG. 15).

The switch processing subroutine 254 is diagrammed in FIG. 17, and monitors the status of the switches on control panel 346, the switches 226 and 228 in air box 124, the status of the switches (not shown) of hand control 361 (see FIG. 14), and pressure sensor pad switches **231*a* and 231*b*. Switch processing subroutine 254 is entered from FIG. 15 at connector 272, assigns a number to each input at step 274, and processes each numbered input in loop fashion. Each input is tested for status at 50 millisecond intervals at step 276, although it will be understood by those skilled in the art who have the benefit of this disclosure that other time intervals may likewise be appropriate for testing the status of the inputs. Switch status is tested by comparing the current switch status with the status of the switch from the last interrupt at step 278. If a change is detected, a switch bounce condition is assumed and the switch number is incremented at step 280 for processing the next switch input. If a change from the prior switch status is not detected, a switch position change test is made at step 282 and switch function is executed at step 284 if a switch change is detected. If the switch status is consistent through three successive tests, no switch position change is indicated and the switch number is incremented at step 280 as described above. Switch number is compared to a limit number at step 286, and if less then that limit number, the switch number is incremented at 285 and the above processing is repeated in loop 288 for the incremented switch number. Provision is made to initialize the switch states on power up by testing at step 287 to determine whether the first pass is being made through the switches. If so, the power down memory is read at 289 and those switches for which data is stored in the electrically alterable ROM are initialized at 283 to reflect the switch status at the time of the previous power off. Switch processing subroutine 254 is exited when the last switch number has been processed and connects back into the control software at 290**.

There are separate switch function routines 284 for each functional set of operator inputs to control panel 346. Referring to FIG. 14, control panel 346 is shown as having air adjust switches 349, 350, 351, 352, 353, 354, and 355. Each air adjust switch 349, 350, 351, 352, 353, 354, and 355 is actually a pair of buttons or a rocker switch which raises or lowers the target pressure to be achieved in the air bags 58, 321, 322, 325, and 328 by each of valves 128, **130*a* and 130*b*, 132*a* and 132*b*, 134*a* and 134*b*. These target pressures are stored in memory locations by microprocessor 240. In the rotation subroutine described below, the target pressures are used as setpoints which the software attempts to achieve and- /or maintain by opening and closing valves 128, 130***a* and 130*b*, 132*a* and 132*b*, 134*a* and 134*b*. There are seven target pressures corresponding to the patient's head, right leg, right body, right shoulder, left leg, left body, and left shoulder, left leg, left body, and left shoulder. The air adjust switches 349, 350, 351, 352, 353, 354, and 355 correspond to each portion of the body of patient 348. In addition, there are three rotation positions designated center, right, and left (see FIGS. 10A, 10C, and 10D) for which corresponding switches 628, 340, and 632 are located on control panel 346, making a total of twenty-one target pressures in all. Microprocessor 240 issues valve control commands which cause the inflation and deflation of air bags 58, 321, 322, 325, and 328 to sequentially and repetitively achieve each of the three rotation positions. Each rotation position is defined by the seven target pressures corresponding to that position. Under normal conditions the target pressures are displayed by the bar graph displays 356 above each corresponding air adjust switch. To change a target pressure, one of the rotation position switches 628, 630, or 632 is depressed and the operator depresses either the upper or lower air adjust switch corresponding to the portion of the body of the patient for which the target pressure is to be changed. A switch function routine 284 then increments or decrements the memory location in RAM which corresponds to that target pressure. At the same time, the changing target pressure is output to the bar graph 356 corresponding to the particular air adjust switch. In this way, each of the seven target pressures for each of the three rotation positions is defined by the operator.

Another switch function routine 284 similar to that described above allows the operator to adjust the pause time, i.e., the period of time during which the patient 348 pauses in each of the positions shown in FIGS. 10A, 10C, and/or 10D, for each rotation position. The pause time is stored in a timer location which the timer routine decrements after each interval interrupt. The pause times for the center, right, and left positions are adjusted by depressing pause adjust buttons 728, 730 and 732, respectively.

Another switch function routine 284 is executed when the switch processing routine 254 detects an operator input from height adjust switches 233, 235, 236, 237, 238, and 239. Switches 233 and 237 raise and lower the frame section 14' of bed 10, respectively, while switches 236 and 239 raise or lower frame section 14'''', respectively. Switches 235 and 238 raise or lower the entire frame 12 of bed 10, respectively. The switch function routine which is executed when one of those switches is depressed causes actuation of the power screws described above to effect the appropriate height adjustment.

Similarly, another switch function routine 284 allows the operator to adjust the temperature at which the air supply to air bags 321, 322, 325 and/or 328 is to be maintained. The target temperature is used as a setpoint by microprocessor 240 to control heater strip 172. The target temperature is adjusted using switches 152A and 152B, and a digital display 168 of the target temperature is driven by the software.

The rotation subroutine 292 is shown in FIG. 18. This routine is entered at connector 294 after general timer subroutine 252 has adjusted the appropriate software timers to determine the rotation position to which the bed is to be either driven or maintained. Subroutine 292 is executed for each of valves 128, 130*a* and 130*b*, 132*a* and 132*b*, 134*a* and 134*b* to alternately inflate and deflate the two sets of air bags 322, 325 and 328 supplied with air by manifolds 76, 78, 80, and 82 and 76', 78', 80' and 82' to roll patient 348 from one side of bed frame 12 to the other. The particular valve number is read at step 296. Next, the target pressure for that particular valve set as described above is read at step 300. At step 308, the individual valve 128, 130*a* and 130*b*, 132*a* and 132*b*, or 134*a* and 134*b* may or may not be adjusted according to the output signal of potentiometer 468 which is also read at step 300. Potentiometer 468 inputs a voltage value to analog-to-digital converter 474 which converts that voltage to a digital value representing the angular displacement of a section 14', 14'', 14''' or 14'''' of bed frame 12 with respect to the adjacent section 14', 14'', 14''' or 14''''. For instance, as the section 14' of frame 12 is pivoted with respect to the section 14'', changing the distribution of the weight of the body of patient 348 supported on the air bags 321, 322, 325 and/or 328 as explained below. Accordingly, microprocessor 240 adjusts the target pressures to compensate for that change in weight distribution.

Referring to FIG. 13, two adjacent frame sections 14' and 14'' are shown joined by hinge 44' Bracket 462 is attached to frame section 14'' by bolt 464 and nut 466. Potentiometer 468 is mounted upon bracket 462 such that the shaft 467 thereof is free to rotate throughout its entire operating range. The shaft 467 of potentiometer 468 and hinge 44' are arranged so that their axes of rotation are aligned. The shaft 467 of potentiometer 468 is journaled in frame section 14'. When frame section 14'' is pivoted with respect to section 14', connector 470 is likewise rotated, causing the rotation of the shaft 467 of potentiometer 468, resulting in a change in the output voltage of potentiometer 468 which is proportional to the angular displacement between frame sections 14' and 14''. That change in output results in a signal which is transmitted by wire 472 to microprocessor 240 (see FIG. 12). The output signal of potentiometer 468 is adjusted so that, for each increment in the elevation of frame section 14' from the horizontal of about 15°, the pressure in the sets of air sacs mounted on baseboards 48 and 50 is increased by about 20% above the base pressure until a maximum angle of 45° from the horizontal is reached.

The threaded shafts 139 of the motors 138 which open or close valves 128, 130*a* and 130*b*, 132*a* and 132*b*, and 134*a* and 134*b* turn very slowly such that the time a motor 138 has been running is used in a linear proportion type algorithm as the timer increments to calculate the theoretical pressure in the coupler 153 of each valve 128, 130*a* and 130*b*, 132*a* and 132*b*, or 134*a* and 134*b* at step 302. Next, the actual pressure from the air chuck 212 (see FIGS. 8, 9A, and 9B) corresponding to the particular valve 128, 130*a* and 130*b*, 132*a* and 132*b*, or 134*a* and 134*b* is read at step 304. The pressure from air chucks 212 is transmitted by air pressure lines 213 to pressure transducers (not shown) mounted in control box 198. The pressure transducers are of a type suitable for reading pressures in the range of about 0–1 psig available Microswitch Corp. (Freeport, Illinois) and Sensym Corp. (Sunnyvale, California). The pressure transducers input a voltage proportional to the particular pressure to an analog-to-digital converter within control box 198 which then inputs to microprocessor 240. The actual pressure is then compared to the target pressure at step 306. A decision is then made to either maintain, close, or open the valve and implemented at steps 308*a*, 308*b*, or 308*c* which cause valve motor subroutine 316 to execute the appropriate action at will be described below.

After execution of step 308, provision is made for display of the air pressure in the couplers 153 of valves 138, 130*a* and 130*b*, 132*a* and 132*b*, and 134*a* and 134*b* on bar graphs 356. The operator selects whether actual or target pressures are displayed at step 310 by whether switches 628, 630 or 632 (see FIG. 14) have been actuated. Actual display data is calculated at step 312 and output at 314 to bar graphs 356 at step 314. If one of switches 628, 630 or 632 has been actuated, target display data is calculated at step 315 and output at 314 as before. Rotation subroutine 292 is then exited at connector 298.

Referring to FIGS. 1 and 14, an auxiliary control panel 850 is mounted on footboard 21 having push button switches 851, 357, 358, 852, and 853 mounted therein. Pushbutton 851 is the main power on/off switch. Depressing pushbutton 358 puts the low air loss bed 10 in the oscillating patient therapy mode whereby microprocessor 240 steps sequentially through the three previously programmed rotation positions. Activating pushbutton 358 places the bed 10 in the air suspension therapy mode, i.e., stopping rotation of the patient 348 at any position intermediate the two extreme positions shown in FIGS. 10A and 10C. Depressing one of pushbuttons 852 or 853 causes the microprocessor 240 to maintain the bed in one of the previously programmed left or right rotation positions.

The valve motor subroutine 316, diagrammed in FIG. 19, converts valve motor movement commands generated by the switch processing and rotation subroutines 254 and 292, respectively, into valve motor operations, i.e., starting, braking, coasting, and reversing each of the motors 138 used to open and/or close valves 128, 130*a* and 130*b*, 132*a* and 132*b*, and 134*a* and 134*b*. Valve motor subroutine 316 is entered at connector 318. Each motor 138 is assigned a number at step 320 and is tested for its requested status, i.e., run or stop, and direction as compared to current status at step 370. Whenever a running motor 138 is requested to stop, the status of that motor is tested at step 372, and if stopped or stopping, the brake timer is tested at step 374 to determine whether the brake timer is zeroed. If the brake timer is not zeroed, the brake timer is decremented at step 376 and tested again at step 378 to determine whether the brake timer is zeroed. If so, the brake is released at step 380 and the number assigned to that motor 138 is compared to the limit number at step 382 to determine whether that motor 138 is the last motor. If the status of the motor 138 is running at step 372, the motor 138 is turned off and the brake set at step 388, and timer is then initialized at step 390. If the motor 138 is not the last motor, the motor timer is decremented at step 386 and the above processing repeated.

Referring again to step 370, if the requested status of the motor 138 tested is that the motor 138 is to run, the current motor status is tested at 392. If the status of the motor 138 being tested is that the motor 138 is stopped or stopping, the requested status and the current status of the motor are compared to determine whether they are the same at step 394. If the requested status and the current status are not the same, the brake timer is tested to determine whether the brake timer is at zero at step 396. If the brake timer is not zeroed, the brake timer is decremented at step 398 and the number assigned that motor 138 is tested at step 382 to determine whether that motor 138 is the last motor. If motor 138 is not the last motor, the motor timer is decremented at step 386 and the above processing repeated. If the brake timer is zeroed at step 396, the direction of rotation of motor 138 is reversed at step 400, motor 138 is turned on at step 402, the motor run timer is initialized at step 404, and the number assigned to that motor 138 is tested at step 382 to determine whether that motor 138 is the last motor. If motor 138 is not the last motor, the motor timer is decremented at step 386 and the above processing repeated. If the requested status and the current status are the same at step 394, motor 138 is turned on at step 402, the motor run timer is initialized at step 404, and the number assigned to that motor 138 is tested to determine whether that motor 138 is the last motor. If motor 138 is not the last motor, the motor timer is decremented at step 386 and the above processing repeated.

Returning to step 392, if the current status of motor 138 is that the motor 138 is running, the requested status and the current status are compared at step 406 to determine whether they are the same. If requested and current status are not the same, motor 138 is switched off and the brake is set at 388, the brake timer is initialized at step 390, and processing continues as described above. If the requested and current status of motor 138 are the same, the motor run timer is tested at step 408 to determine whether the run timer is zeroed. If the run timer is not zeroed, the motor run timer is decremented at step 410 and tested again at step 412 to determine whether the run timer is zeroed. If so, motor 138 is turned off at step 414, the number assigned to motor 138 is compared to the limit number at step 382 to determine whether motor 138 is compared to the limit number at step 382 to determine whether motor 138 is the last motor, and processing continues as described above. If the run timer is zeroed at step 408 or 412, the number assigned to motor 138 is compared to the limit number at step 382 to determine whether motor 138 is the last motor and processing continues as described above.

A power fail interrupt subroutine 416, diagrammed in FIG. 20, writes certain controller configuration parameters such as blower and rotation mode status in the electrically alterable ROM in the event of a power failure or when low air loss bed 10 is unplugged. Power fail interrupt subroutine 416 is entered upon receipt of an interrupt from an external hardware interrupt (not shown). If the electrically alterable ROM power on delay before erase timer (EEROM timer) tested at step 418 is zeroed, i.e., if low air loss bed 10 has been powered on for more than a few seconds such that the electrically alterable ROM is available for writing, the aforementioned parameters are stored to memory at step 420 and the EEROM timer is initiated at step 422 before returning to the codes before the interrupt at step 424. If the EEROM timer is not zeroed at step 418, low air loss bed 10 has probably just been powered on and the memory is not available for writing. Should the control software (see FIG. 15) receive a power interruption that generates the power fail interrupt and performs the memory write but does not actually interrupt power to the control software, power fail interrupt subroutine 416 initializes the EEROM timer and will be available to rewrite the memory after the EEROM timer has once again timed out.

As noted above, the frame 12 is hinged at 44', 44'' and 44''', allowing the baseboards 46 and 52 to be raised from the horizontal, changing the angle of inclination for the comfort of 348 patient or for therapeutic purposes. However, especially when head baseboard 52 is raised, the deviation from the horizontal places a disproportionate amount of the weight of patient 348 on the air bags 322 over the legs 48 and seat 50 baseboards. In a presently preferred embodiment of the present invention, there are only three air bags 322 mounted on each of the baseboards 48 and 50, such that a great proportion of the patient's weight, which is spread out over more than 20 of the air bags 58, 322 and 328 when the sections 14', 14'', 14''' and 14'''' are all in the same horizontal plane, is concentrated onto as few as six of the air bags 322. Pressure sensor pad switches 231*a* and 231*b* (see FIG. 14) are placed flat on legs baseboard 48 and seat baseboard 50 so that, in the event a portion of the patient's body contacts either one of those switches 231*a* or 231*b*, the above-described buzzer is activated by microprocessor 240, and can be silenced by activation of switch 347 by the operator, and the air pressure in air bags 322 mounted to seat baseboard 50 can be raised by the operator.

Referring to FIG. 12, there is shown a schematic electrical diagram of a low air loss bed constructed according to the teachings of the present invention. Alternating current enters the circuitry in electric cord 218, which is connected to power distribution board 219. Power distribution board 219 includes a power supply module 220 to supply power to microprocessor 240 through cable 211 and solid state relays to control each of the blowers 108 and heater strip 172. Power distribution board 219 provides power to the motors (not shown) within boxes 45 for raising, lowering and positioning the frame 12 of low air loss bed 10 by means of lead 223 which connects to the junction box 224 of bed circuitry 43. Power distribution board 219 also powers the electric motors 114 of blowers 108. Each of the blowers 108 is provided with a capacitor 236, and switch 192 is provided on control panel 346 for deactivation of one of the blowers 108 by virtue of the connection provided by cable 243 to switch 241 on blowers 108.

Referring to FIG. 14, a temperature sensor, shown schematically at 194, is located in seat manifold 80. When the target temperature set by the operator using switches 152A or 152B and display 168 is less than the temperature of the air in seat manifold 80, heating strip 172 is switched on by microprocessor 240. Heating strip 172 is provided with current by wires $167_i$ and $167_o$ from main power supply module 220 (see FIG. 12). Switch 191 on control panel 346 is used to activate or deactivate heating strip 172.

Limit switches 226 and 228 are provided in manifold plate 145 and on full inflate plate 144, respectively (see FIGS. 4, 8, 9A and 14). Limit switch 226 is closed when push button 230 is engaged by dump plate. When push button 230 is disengaged by the movement of dump plate 150 away from manifold plate 145 under the influence of levers 165, the circuit is opened and blowers 108 are shut off. Limit switch 228 is affixed to full inflate plate 144 by screws 232, and the circuit is open when lever arm 234 engages manifold plate 145. When full inflate plate 144 is opened under the influence of full inflate knobs 193, limit switch 228 is closed, activating both blowers 108 if not already on and the buzzer which is incorporated into microprocessor 240. A switch 347 is provided on control panel 346 to silence that buzzer.

Control panel 346 is connected to controller 198 by ribbon connectors 200. Controller 198 includes microprocessor 240 and the other necessary circuitry. Controller 198 is provided with plug-type receptors 205 for receiving the plugs 207 of cables 108, 211, 225, 227 and 229.

Cable 208 connects controller 198 to temperature sensor 194 and the pressure sensor pad switches 231. Cable 211 connects directly to power distribution board 219 and feeds power to controller 198 while conducting control signals to power distribution board 219 to control the functions of blowers 108 and heating strip 172. Cables 170*a* and 170*b* are provided with separate wires $184_i$ and $184_o$ for each motor 138, thereby conducting low voltage D.C. current to each of the motors 138. Cable 170*a* is also provided with separate wires $226_i$ and $226_o$ and $228_i$ and $228_o$ connecting separately to limit switches 226 and $228_i$ respectively.

Cable 227 is provided with plugs 359 and the other end from plug 207 for engaging a complementary plug 360 on a separate hand control 361 which duplicates the function of switches 349–358 on control panel 346. Hand controls 361 are shown schematically in FIG. 14 because they merely duplicate keyboard 346 functions. Plugs 359 are provided on both sides of bed frame 12 (not shown in FIG. 14) to facilitate easy access by hospital personnel with hand control 361.

Cable 229 is provided with plugs 362 and 363 at the other end from plug 207 for engaging complementary plugs 364 and 366, respectively. Plug 364 is located in the circuitry of the board frame 12 in circuit box 43 (see FIG. 7), shown schematically at box 367. Plug 366 is located on a hand control, shown schematically at 368, which duplicates the function of switches 233 and 235–239 on control panel 346. When hand control 368 is used to adjust the angle of inclination of head and foot baseboards 54 and 46, respectively, signals generated by activation of the switches (not shown) on hand control 368 are transmitted directly to the circuitry 367 of bed frame 12.

Although the present invention has been described in terms of the foregoing preferred embodiments, this description has been provided by way of explanation only and is not to be construed as a limitation of the invention, the scope of which is limited only by the following claims.

What is claimed is:

1. A patient support system comprising:

a frame means;

first and second sets of separately inflatable air bags for maintaining low interface pressures between the surface of the air bags and a patient supported on the top surface thereof, the air bags having varying shaped cutouts formed near one end of the top surface thereof, the air bags of said first set of air bags being mounted transversely to said frame means with the cutout closer to a first side of said frame means for receiving one side of the patient when the patient is rolled toward the first side of said frame means, and the air bags of said second set of air bags being mounted transversely to said frame means with the cutout closer to a second side of said frame means for receiving the other side of the patient when the patient is rolled toward the second side of said frame means;

means for selecting a base line pressure in the air bags of said first and second sets of air bags;

means for selecting first and second target pressures to which the air bags of each of said first and second sets of air bags are to be inflated; and means for sensing the air pressure in the air bags of said first and second sets of air bags and comparing the air pressure in the air bags to the target pressure selected for each of said sets of air bags and, then, alternately inflating the air bags of said first set of air bags to the selected first target pressure when the air pressure in said first set of air bags is lower than the first target pressure selected for said first set of air bags to roll the patient toward the first side of said frame means when said first set of air bags is inflated and inflating the air bags of said second set of air bags to the second target pressure selected for said second set of air bags when the air pressure in said second set of air bags is lower than the second target pressure selected for said second set of air bags to roll the patient toward the second side of said frame means, thereby therapeutically inhibiting the formation and permitting the healing of bed sores and inhibiting the development of pulmonary congestion.

2. The patient support system of claim 1 additionally comprising:

means for storing a plurality of first and second target pressure pairs wherein each pressure pair corresponds to a rotation position; and means for sequentially and repetitively advancing the patient support system to each rotation position by inflating said first and second air bags to the target pressures defining the rotation position.

3. The patient support system of claim 1 wherein:

a plurality of the air bags of each of said first and second sets of air bags are mounted to a first section of said frame means in a separately inflatable set of air bags; and a second section of said frame means is hinged to said frame means to allow inclination thereof for the comfort or therapy of the patient.

4. The patient support system of claim 3 additionally comprising means responsive to the inclination of the second section of said frame means to increase the air flow to the air bags mounted to the first section of the frame means in response to the inclination to maintain inflation of the first section of the frame means.

5. A patient support system comprising:

a frame means;

a first set of air bags for supporting a patient on the top surface thereof mounted transversely on said frame means;

a second set of air bags for supporting a patient on the top surface thereof, the air bags of said second set of air bags being mounted transversely on said frame means between the air bags of said first set of air bags;

means for inflating each of the air bags of said first and second sets of air bags to a baseline pressure;

means for separately inflating each of said first and second sets of air bags to a selected target pressure by comparing the actual pressure in each of said first and second sets of air bags to the target pressure selected for each of said first and second sets of air bags and increasing the air flow from said inflating means in response to any difference which may exist between the baseline pressure and the target pressure selected therefor;

means formed in the top surface of the air bags of said first set of air bags for lowering one side of the patient supported thereon, thereby rolling the patient toward a first side of said frame means, when the air flow to said first set of air bags is increased; and means formed in the top surface of the air bags of said second set of air bags for lowering the other side of the patient supported thereon, thereby rolling the patient toward a second side of said frame means, when the air flow from said inflating means to said second set of air bags is increased.

6. The patient support system of claim 5 wherein the air bags of said first and second sets of air bags are mounted in separately inflatable groups to separate sections of said frame means.

7. The patient support system of claim 6 wherein said inflating means comprises means for selecting a target pressure for each of the separately inflatable groups of said first and second sets of air bags.

8. The patient support system of claim 6 wherein a first section of said frame means is hinged to a second section of said frame means to allow adjustment of the angle of inclination thereof for the comfort or therapy of the patient.

9. The patient support system of claim 8 additionally comprising means for sensing inclination of the first section of said frame means and, in response, increasing the flow of air to the air bags mounted to the second section of said frame means to maintain inflation of the group of said first and second sets of air bags mounted to the second section of said frame means.

10. A patient support system comprising:

a frame including a plurality of sections, a first section of said frame being pivotable with respect to a second section of said frame;

a plurality of separately inflatable air bags mounted transversely on each of the first and second sections of said frame for maintaining low interface pressures between the surface of said air bags and a patient supported on the top surface thereof, a first group of said air bags being mounted on the first section of said frame and a second group of said air bags being mounted on the second section of said frame;

means for selecting a target pressure for each of the groups of said air bags;

means for sensing the actual pressure in each of the groups of said air bags; and means for adjusting the target pressure for the second group of air bags responsive to pivoting of the first section of said frame and comparing the adjusted target pressure with the sensed target pressure of the second group of air bags to maintain the adjusted target pressure.

11. The patient support system of claim 10 wherein said air bags include first and second separately inflatable sets of air bags, the air bags of said second set of air bags being mounted between the air bags of said first set of air bags, which are alternately inflated and deflated to support the patient.

12. The patient support system of claim 11 wherein each of the air bags of said first set of air bags is provided with a cutout formed in the top surface thereof and positioned close to a first side of said frame and each of the air bags of said second set of air bags is provided with a cutout formed in the top surface thereof and positioned close to a second side of said frame whereby inflation of said first set of air bags causes the patient to be rolled toward the first side of said frame, one side of the patient being received within the cutouts formed in the air bags of said first set of air bags, and inflation of said second set of air bags causes the patient to be rolled toward the second side of said frame, the other side of the patient being received within the cutouts formed in the air bags of said second set of air bags.

13. A method of compensating for the changes in the proportion of the weight of a patient supported on a low air loss patient support system caused by the pivoting of one section of the frame of the patient support system comprising:

inflating a plurality of air bags mounted to first and second sections of the frame of a low air loss patient support system to a selected target pressure for supporting a patient on the top surface thereof at low interface pressures;

pivoting the first section of the frame with respect to the second section of the frame, thereby changing the proportion of the weight of the patient supported by the air bags mounted to the second section of the frame;

sensing inclination of the first section of the frame;

adjusting the target pressure for the air bags mounted to the second section of the frame in response to inclination of the first section;

sensing the actual pressure in the air bags mounted to the second section of the frame and comparing that actual pressure to the adjusted target pressure; and increasing the flow of air supplied to the air bags mounted to the second section of the frame when actual pressure is less than the adjusted target pressure to maintain the low interface pressures by compensating for the increased proportion of the weight of the patient supported by the air bags mounted to the second section of the frame.

14. The method of claim 13 wherein the flow of air supplied to the air bags of the second section of the frame is increased so that, for an increment in the angle of inclination of the first section of the frame of about 15 degrees, the flow of air supplied to the air bags mounted to the second section of the frame is increased so as to increase the air pressure therein by about 20% above the selected target pressure.

15. The method of claim 13 additionally comprising separately alternately inflating first and second sets of the air bags mounted to each of the first and second sections of the frame to a second selected target pressure to alternately support the patient on the first set of air bags and then the second set of air bags.

16. THe method of claim 15 wherein the patient is rolled toward alternate sides of the frame by lowering one side of the patient into cutouts formed in the top surface of each of the air bags of the first and second sets of air bags when a set of air bags is inflated.

17. A method of preventing pressure points and bed sores on a patient comprising:

supporting a patient on a plurality of air bags mounted transversely to a frame means and having varying shaped cutouts formed in the top surface thereof that are inflated to a baseline pressure to maintain low interface pressures between the air bags and the patient supported thereon;

selecting a target pressure to which the air bags are to be inflated;

comparing the air pressure in the air bags and the selected target pressure;

alternately rolling the patient by separately adjusting the air pressure in the air bags to raise the air pressure from the baseline pressure to the selected target pressure, the patient being rolled by lowering one side of the patient into and out of the cutouts as the air pressures in the air bags change, thereby promoting the healing of bed sores caused by prolonged contact with hard surfaces and inhibiting the development of pulmonary congestion.

18. The method of claim 17 wherein the air bags are mounted to the frame means in first and second separately inflatable sets, the cutouts in the top surface of the air bags of the first set of air bags being positioned closer to a first side of the frame means than the second side of the frame means, and the cutouts in the top surface of the air bags of the second set of air bags being positioned closer to a second side of the frame means than the first side of the frame means.

19. The method of claim 18 wherein the air pressures of the first and second sets of air bags are alternately raised from the baseline pressure to the selected target pressure.

20. The method of claim 19 wherein the adjustment of the air pressures of the air bags of the first and second sets of air bags is periodically interrupted for a selected period of time.

21. THe method of claim 19 additionally comprising maintaining a selected baseline pressure in a third set of air bags for supporting the head of the patient while alternately inflating the air bags of the first and second sets of air bags.

22. The method of claim 17 wherein the air bags are mounted to the frame means in separately inflatable groups and target pressures are selected for each of the separately inflatable groups of air bags.

23. A control system for controlling a patient support which includes a plurality of transversely oriented air bags for supporting a patient, comprising:

means for sensing air pressure in first and second sets of separately inflatable air bags; and control means for controlling the provision of pressurized gas to said first and second sets in response to pressures sensed by said sensing means to inflate the bags in a manner which inhibits the formation of bed sores and other complications of a patient supported on the bags;

said control means including means for causing and controlling rotation of a patient on the bags to help prevent complications of prolonged immobility.

24. A control system for controlling a patient support which includes a plurality of transversely oriented air bags for supporting a patient, comprising:

means for sensing air pressure in first and second sets of separately inflatable air bags; and control means for controlling the provision of pressurized gas to said first and second sets in response to pressures sensed by said sensing means to inflate the bags in a manner which inhibits the formation of bed sores and other circulatory complications of a patient supported on the bags;

said control means including:

means for causing and controlling rotation of a patient on the bags to help prevent complications of prolonged immobility;

means for selecting first and second target pressures to which said first and second sets are to be inflated; and means linked with said sensing means for comparing the pressures sensed by said sensing means with the respective ones of said first and second target pressures and, then, controlling the provision of pressurized gas to the bags in response to the comparison by said comparing means.

25. A control system for controlling a patient support which includes a plurality of transversely oriented air bags for supporting a patient, comprising:

means for sensing air pressure in first and second sets of separately inflatable air bags of a patient support;

means linked with said sensing means for comparing the pressures sensed by said sensing means with first and second target pressures, said first and second target pressures normally being equal to baseline pressures for inhibiting the formation of bed sores and other circulatory complications of a patient supported on the bags; and means for controlling the provision of pressurized gas to said first and second sets to inflate the bags of said first and second sets to said first and second target pressures in response to the comparison by said comparing means; and means for changing said first and second target pressures to cause rotation of a patient supported on the bags to help prevent complications of prolonged immobility.

26. The control system of claim 25 wherein:

said pressure changing means includes means for selecting said first and second target pressures from a plurality of first and second target pressures pairs wherein each pair corresponds to a rotation position.

27. The control system of claim 25 wherein said pressure changing means is selectively actuable.

28. A feedback-controlled patient support structure, comprising:

(a) a frame, said frame being articulatable to vary the position of a patient lying on the support structure, said frame including an articulatable first section;

(b) a plurality of elongated inflatable air sacs atop said frame;

(c) gas supply means in communication with each of said air bags for supplying gas to same:

(d) control means associated with said gas supply means and said air bags for controlling supply of gas to each of said air bags according to predetermined target pressure values and according to a plurality of predetermined groups of said air bags, each said group defining a separate support zone;

(e) means associated with said frame for sensing one of a plurality of degrees of articulation of said first section of said frame;

(f) said control means operatively associated with said articulation sensing means to adjust the target pressure of said groups in response to the degree of articulation of the first section of the frame as determined by said articulation sensing means;

(g) pressure sensing means in fluid communication with said air bags for sensing pressures in said air bags; and (h) said control means operatively associated with said pressure sensing means to control gas pressure in said air bags in response to the pressures sensed by said pressure sensing means.

29. A feedback-controlled patient support structure, comprising:

a frame, said frame including at least one articulatable section for varying the position of a patient lying on the support structure;

a plurality of elongated inflatable air bags atop said frame;

gas supply means in communication with each of said air bags for supplying gas to same;

control means associated with said gas supply means and said air bags, for controlling supply of gas to each of said air bags according to predetermined target pressures and according to a plurality of predetermined groups of said air bags, each said group of air bags defining a separate support zone;

articulation sensing means associated with said frame for sensing at least one of a plurality of degrees of articulation of one of said articulatable sections of said frame, said articulation sensing means operating to sense when said one articulatable section attains at least one predetermined articulated position, and said articulation sensing means further comprising a cable having one end communicating with one of said articulatable sections of said frame whereby articulating movement of said one articulatable section displaces said cable along the longitudinal axis thereof, said cable having a lever on the opposite end thereof;

said control means being operatively associated with said articulation sensing means to vary gas pressure in predetermined air bags, by adjusted the target pressures according to the degree of articulation of said one of said articulatable sections of said frame, as determined by said articulation sensing means;

said control means further comprising a valve control circuit and a multi-outlet, variable flow, gas valve means having at least one motor for varying the flow through one of the outlets of said gas valve means;

said valve control circuit further comprising a power supply for driving said at least one motor of said valve means, and said power supply being connected to said motor to drive same and adjust the flow of said at least one outlet;

pressure sensing means in fluid communication with said air bags for sensing pressures in said air bags; and said control means operatively associated with said pressure sensing means to control gas pressure in said air bags in response to the pressures sensed by said pressure sensing means.

* * * * *